US006712880B2

(12) United States Patent
Foglietta et al.

(10) Patent No.: US 6,712,880 B2
(45) Date of Patent: Mar. 30, 2004

(54) CRYOGENIC PROCESS UTILIZING HIGH PRESSURE ABSORBER COLUMN

(75) Inventors: Jorge H. Foglietta, Missouri City, TX (US); Hazem Haddad, Houston, TX (US); Earle Ross Mowrey, Houston, TX (US); Sanjiv N. Patel, Sugarland, TX (US); Ajit Sangave, Houston, TX (US)

(73) Assignee: ABB Lummus Global, Inc., Houston, TX (US)

( * ) Notice: Subject to any disclaimer, the term of this patent is extended or adjusted under 35 U.S.C. 154(b) by 69 days.

(21) Appl. No.: 10/003,388

(22) Filed: Oct. 22, 2001

(65) Prior Publication Data

US 2002/0157538 A1 Oct. 31, 2002

Related U.S. Application Data

(60) Provisional application No. 60/272,417, filed on Mar. 1, 2001, and provisional application No. 60/274,069, filed on Mar. 7, 2001.

(51) Int. Cl.[7] ..... B01D 53/14

(52) U.S. Cl. ..... 95/184; 95/204; 95/227; 95/228; 95/237; 62/618; 62/625

(58) Field of Search ..... 95/237, 238, 239, 95/240, 227, 228, 229, 184, 193, 194, 204; 62/618, 625, 636, 635, 632, 620, 621, 623, 630

(56) References Cited

U.S. PATENT DOCUMENTS

| | | | |
|---|---|---|---|
| 3,675,435 | A | 7/1972 | Jackson et al. |
| 4,251,249 | A | 2/1981 | Gulsby |
| 4,596,588 | A | 6/1986 | Cook |
| 4,617,039 | A | 10/1986 | Buck |
| 4,657,571 | A | 4/1987 | Gazzi |
| 4,690,702 | A | 9/1987 | Paradowski et al. |
| 4,705,549 | A | 11/1987 | Sapper |
| 4,854,955 | A | 8/1989 | Campbell et al. |
| 4,869,740 | A | 9/1989 | Campbell et al. |
| 4,889,545 | A | 12/1989 | Campbell et al. |
| 4,895,584 | A | 1/1990 | Buck et al. |
| 4,966,612 | A | 10/1990 | Bauer |
| 5,275,005 | A | 1/1994 | Campbell et al. |
| 5,555,748 | A | 9/1996 | Campbell et al. |
| 5,568,737 | A | 10/1996 | Campbell et al. |
| 5,685,170 | A | 11/1997 | Sorensen |
| 5,799,507 | A | 9/1998 | Wilkinson et al. |
| 5,881,569 | A | 3/1999 | Campbell et al. |
| 5,992,175 | A | 11/1999 | Yao et al. |
| 6,116,050 | A | 9/2000 | Yao et al. |
| 6,182,469 | B1 | 2/2001 | Campbell et al. |
| 6,244,070 | B1 | 6/2001 | Chen et al. |
| 2001/0052241 | A1 | 12/2001 | Chen et al. |

FOREIGN PATENT DOCUMENTS

| | | |
|---|---|---|
| EP | 0 182 643 A | 5/1986 |
| WO | WO 00 34724 A | 6/2000 |
| WO | WO 02 14763 A | 2/2002 |

*Primary Examiner*—Duane S. Smith
(74) *Attorney, Agent, or Firm*—Bracewell & Patterson, L.L.P.

(57) ABSTRACT

A cryogenic process and apparatus for separating multi-component gaseous hydrocarbon streams to recover both gaseous and liquid compounds. More particularly, the cryogenic processes and apparatus of this invention utilize a high pressure absorber to improve the energy efficiency of processing natural gas for pipeline gas sales and recovering natural gas liquids (NGL) gas from gaseous hydrocarbon streams.

45 Claims, 10 Drawing Sheets

CRYOGENIC PROCESS UTILIZING HIGH PRESSURE ABSORBER COLUMN

This application claims the benefits of provisional patent applications, U.S. Ser. No. 60/272,417, filed on Mar. 1, 2001 and U.S. Ser. No. 60/274,069, filed on Mar. 7, 2001, both incorporated by reference.

BACKGROUND OF THE INVENTION

1. Technical Field

This invention relates to cryogenic gas processes for separating multi-component gaseous hydrocarbon streams to recover both gaseous and liquid compounds. More particularly, the cryogenic gas processes of this invention utilize a high pressure absorber.

2. Background and Prior Art

In most plants, gas processing capacity is generally limited by the horsepower available for recompression of the pipeline sales gas stream. The feed gas stream is typically supplied at 700–1500 psia and expanded to a lower pressure for separation of the various hydrocarbon compounds. The methane-rich stream produced is typically supplied at about 150–450 psia and is recompressed to pipeline sales gas specifications of 1000 psia or above. This pressure difference accounts for the major portion of the horsepower requirement of a cryogenic gas processing plant. If this pressure difference can be minimized, then more recompression horsepower will be available, thereby allowing increased plant capacity of existing gas processing plants. Also, the process of the invention may offer reduced energy requirements for new plants.

Cryogenic expansion processes produce pipeline sales gas by separating the natural gas liquids from hydrocarbon feed gas streams.

In the prior art cryogenic processes, a pressurized hydrocarbon feed gas stream is separated into constituent methane, ethane ($C_2$) compounds and/or propane ($C_3$) compounds via a single column or a two-column cryogenic separation schemes. In single column schemes, the feed gas stream is cooled by heat exchange contact with other process streams or external refrigeration. The feed gas stream may also be expanded by isentropic expansion to a lower pressure and thereby further cooled. As the feed stream is cooled, high pressure liquids are condensed to produce a two-phase stream that is separated in one or more cold separators into a high pressure liquid stream and a methane-rich vapor stream in one or more cold separators. These streams are then expanded to the operating pressure of the column and introduced to one or more feed trays of the column to produce a bottom stream containing $C_2$ compounds and/or $C_3$ compounds and heavier compounds and an overhead stream containing methane and/or $C_2$ compounds and lighter compounds. Other single column schemes for separating high pressure hydrocarbon streams are described in U.S. Pat. Nos. 5,881,569; 5,568,737; 5,555,748; 5,275,005 to Campbell et al; U.S. Pat. No. 4,966,612 to Bauer; U.S. Pat. Nos. 4,889,545; 4,869,740 to Campbell; and U.S. Pat. No. 4,251,249 to Gulsby.

Separation of a high pressure hydrocarbon gaseous feed stream may also be accomplished in a two-column separation scheme that includes an absorber column and a fractionation column that are typically operated at very slight positive pressure differential. In the two-column separation scheme for recovery of $C_{2+}$ and/or $C_{3+}$ natural gas liquids, the high pressure feed is cooled and separated in one or more separators to produce a high pressure vapor stream and a high pressure liquid stream. The high pressure vapor stream is expanded to the operating pressure of the fractionation column. This vapor stream is supplied to the absorber column and separated into an absorber bottom stream and an absorber overhead vapor stream containing methane and/or $C_2$ compounds along with trace amounts of nitrogen and carbon dioxide. The high pressure liquid stream from the separators and the absorber bottom stream are supplied to a fractionation column. The fractionation column produces a fractionation column bottom stream which contains $C_{2+}$ compounds and/or $C_{3+}$ compounds and a fractionation column overhead stream which may be condensed and supplied to the absorber column as reflux. The fractionation column is typically operated at a slight positive pressure differential above that of the absorber column so that fractionation column overheads may flow to the absorber column. In many of the two-column systems, upsets occur that cause the fractionation column to pressure up, particularly during startup. Pressuring up of the fractionation column poses safety and environmental threats, particularly if the fractionation column is not designed to handle the higher pressure. Other two-column schemes for separating high pressure hydrocarbon streams are described in U.S. Pat. No. 6,182,469 to Campbell et al.; U.S. Pat. No. 5,799,507 to Wilkinson et at.; U.S. Pat. No. 4,895,584 to Buck et al.; U.S. Pat. No. 4,854,955 to Campbell et al.; U.S. Pat. No. 4,705,549 to Sapper; U.S. Pat. No. 4,690,702 to Paradowski et al.; U.S. Pat. No. 4,617,039 to Buck; and U.S. Pat. No. 3,675,435 to Jackson et al.

U.S. Pat. No. 4,657,571 to Gazzi discloses another two-column separation scheme for separating high pressure hydrocarbon gaseous feed streams. The Gazzi process utilizes an absorber and fractionation column that operate at higher pressures than the two-column schemes discussed above. However, the Gazzi process operates with the absorber pressure significantly greater than the fractionation column pressure, as opposed to most two-column schemes that operate at a slight pressure differential between the two vessels. Gazzi specifically teaches the use of a dephlegmator within the fractionation column to strip the feedstreams of a portion of the heavy constituents to provide a stripping liquid for use in the absorber. Gazzi's tower operating pressures are independent of each other. The separation efficiency of the individual towers is controlled by individually altering the operating pressure of each tower. As a result of operating in this manner, the towers in the Gazzi process must operate at very high pressures in order to achieve the separation efficiency desired in each tower. The higher tower pressures require higher initial capital costs for the vessels and associated equipment since they have to be designed for higher pressures than for the present process.

It is known that the energy efficiency of the single column and two-column separation schemes may be improved by operating such columns at higher pressure, such as in the Gazzi patent. When operating pressures are increased, however, separation efficiency and liquid recovery are reduced, often to unacceptable levels. As column pressures increase, the column temperatures also increase, resulting in lower relative volatilities of the compounds in the columns. This is particularly true of the absorber column where the relative volatility of methane and gaseous impurities, such as carbon dioxide, approach unity at higher column pressure and temperature. Also, the number of theoretical stages in respective columns will have to increase in order to maintain separation efficiency. However, the impact of the residue gas compression costs prevails above other cost components. Therefore, the need exists for a separation scheme that operates at high pressures, such as pressures above about 500 psia, yet maintains high hydrocarbon recoveries at reduced horsepower consumption.

Earlier patents have addressed the problem of reduced separation efficiency and liquid recovery, typically, by introducing and/or recycling ethane-rich streams to the column. U.S. Pat. No. 5,992,175 to Yao discloses a process for improving recovery of $C_{2+}$ and $C_{3+}$ natural gas liquids in a single column operated at pressures of up to 700 psia. Separation efficiency is improved by introducing to the column a stripping gas rich in $C_2$ compounds and heavier compounds. The stripping gas is obtained by expanding and heating a liquid condensate stream removed from below the lowest feed tray of the column. The two-phase stream produced is separated with the vapors being compressed and cooled and recycled to the column as a stripping gas. However, this process has unacceptable energy efficiency due to the high recompression duty that is inherent in one-column schemes.

U.S. Pat. No. 6,116,050 to Yao discloses a process for improving the separation efficiency of $C_{3+}$ compounds in a two-column system, having a demethanizer column, operated at 440 psia, and a downstream fractionation column, operated at 460 psia. In this process, a portion of a fractionation column overhead stream is cooled, condensed and separated with the remaining vapor stream combined with a slip stream of pipeline gas. These streams are cooled, condensed and introduced to the demethanizer column as an overhead reflux stream to improve separation of $C_3$ compounds. Energy efficiency is improved by condensing the overhead stream by cross exchange with a liquid condensate from a lower tray of the fractionation column. This process operates at less than 500 psia.

U.S. Pat. No. 4,596,588 to Cook discloses a process for separating a methane-containing stream in a two-column scheme, which includes a separator operating at a pressure that, is greater than that of a distillation column. Reflux to the separator may be obtained from one of the following sources: (a) compressing and cooling the distillation column overhead vapor; (b) compressing and cooling the combined two-stage separator vapor and distillation column overhead vapor; and (c) cooling a separate inlet vapor stream. This process also appears to operate at less than 500 psia.

Heretofore, there has not been a cryogenic process for separating multi-compound gaseous hydrocarbon streams to recover both gaseous and liquid compounds in one or more high pressure columns. Therefore, the need exists for a two-column scheme for separating a high pressure, multi-compound stream wherein the pressure of an absorber is substantially greater than and at a predetermined differential pressure from the pressure of a downstream fractionation column that improves energy efficiency, while maintaining separation efficiency and liquid recovery.

The present invention disclosed herein meets these and other needs. The goals of the present invention are to increase energy efficiency, provide a differential pressure between the absorber and fractionation columns, and to protect the fractionation column from rising pressure during startup of the process.

SUMMARY OF THE INVENTION

The present invention includes a process and apparatus for separating a heavy key component from an inlet gas stream containing a mixture of methane, $C_2$ compounds, $C_3$ compounds and heavier compounds wherein an absorber is operated at a pressure that is substantially greater than the fractionation column pressure and at a specific or predetermined differential pressure between the absorber and the fractionation column. The heavy key component can be $C_3$ compounds and heavier compounds or $C_2$ compounds and heavier compounds. The differential pressure in this process is about 50 psi to 350 psi between the absorber and the fractionation column.

An inlet gas stream containing a mixture of methane, $C_2$ compounds, $C_3$ compounds and heavier compounds is cooled, at least partially condensed and separated in a heat exchanger, a liquid expander, vapor expander, an expansion valve or combinations thereof, to produce a first vapor stream and a first liquid stream. The first liquid stream may be expanded and supplied to a fractionation column along with a fractionation feed stream and a fractionation reflux stream. These feed streams may be supplied to a middle portion of the fractionation column and warmed by heat exchange contact with residue gas, inlet gas, absorber overhead stream, absorber bottom stream and combinations thereof in an apparatus such as consisting of a heat exchanger and a condenser. The fractionation column produces a fractionation overhead vapor and a fractionation bottom stream. The first vapor stream is supplied to an absorber along with an absorber reflux stream to produce an absorber overhead stream and an absorber bottom stream.

At least a portion of the fractionation overhead stream is at least partially condensed and separated to produce a second vapor stream and the fractionation reflux stream. The second vapor stream is compressed to essentially about the absorber pressure to produce a compressed second vapor stream that is at least partially condensed by heat exchange contact with one or more process streams such as the absorber bottom stream, the absorber overhead stream, at least a portion of the first liquid stream or combinations thereof. The compressed second vapor stream contains a major portion of the methane in the fractionation feed stream and second fractionation feed stream. When the heavy key component is $C_3$ compounds and heavier compounds, then the compressed second vapor stream additionally contains a major portion of the $C_2$ compounds in the fractionation feed stream and second fractionation feed stream. This stream is then supplied to the absorber as an absorber feed stream. The absorber overhead stream may be removed as a residue gas stream containing substantially all of the methane and/or $C_2$ compounds and a minor portion of $C_3$ or $C_2$ compounds. Such residue gas stream is then compressed to pipeline specifications of above about 800 psia. The fractionation bottom stream can be removed as a product stream containing substantially all of the $C_3$ compounds and heavier compounds and a minor portion of the methane and $C_2$ compounds.

In this invention, the absorber pressure is above about 500 psia. The apparatus for separating the heavy key component from an inlet gas stream containing a mixture of methane, $C_2$ compounds, $C_3$ compounds and heavier compounds, includes a cooling means. When the heavy key component is $C_3$ compounds and heavier compounds, an apparatus for separating the heavy key component from an inlet gas stream comprises a cooling means for at least partially condensing the inlet gas stream to produce a first vapor stream and a first liquid stream; a fractionation column for receiving the first liquid stream, a fractionation feed stream and a second fractionation feed stream, the fractionation column produces a fractionation bottom stream and a fractionation overhead vapor stream; a condenser for at least partially condensing the overhead vapor stream to produce a second vapor stream and a fractionation reflux stream; an absorber for receiving at least a portion of the first vapor stream and an absorber feed stream, the absorber produces an absorber overhead stream and a second fractionation feed stream, the absorber having a pressure that is substantially greater than and at a predetermined differential pressure from the fractionation column pressure; a compressor for compressing the second vapor stream essentially to absorber pressure to produce a compressed second vapor stream; a condensing means for at least partially condensing the compressed second vapor stream to produce the absorber feed stream; and whereby the fractionation bottom stream contains a majority of heavy key components and heavies.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF PREFERRED EMBODIMENT

Figure 1:
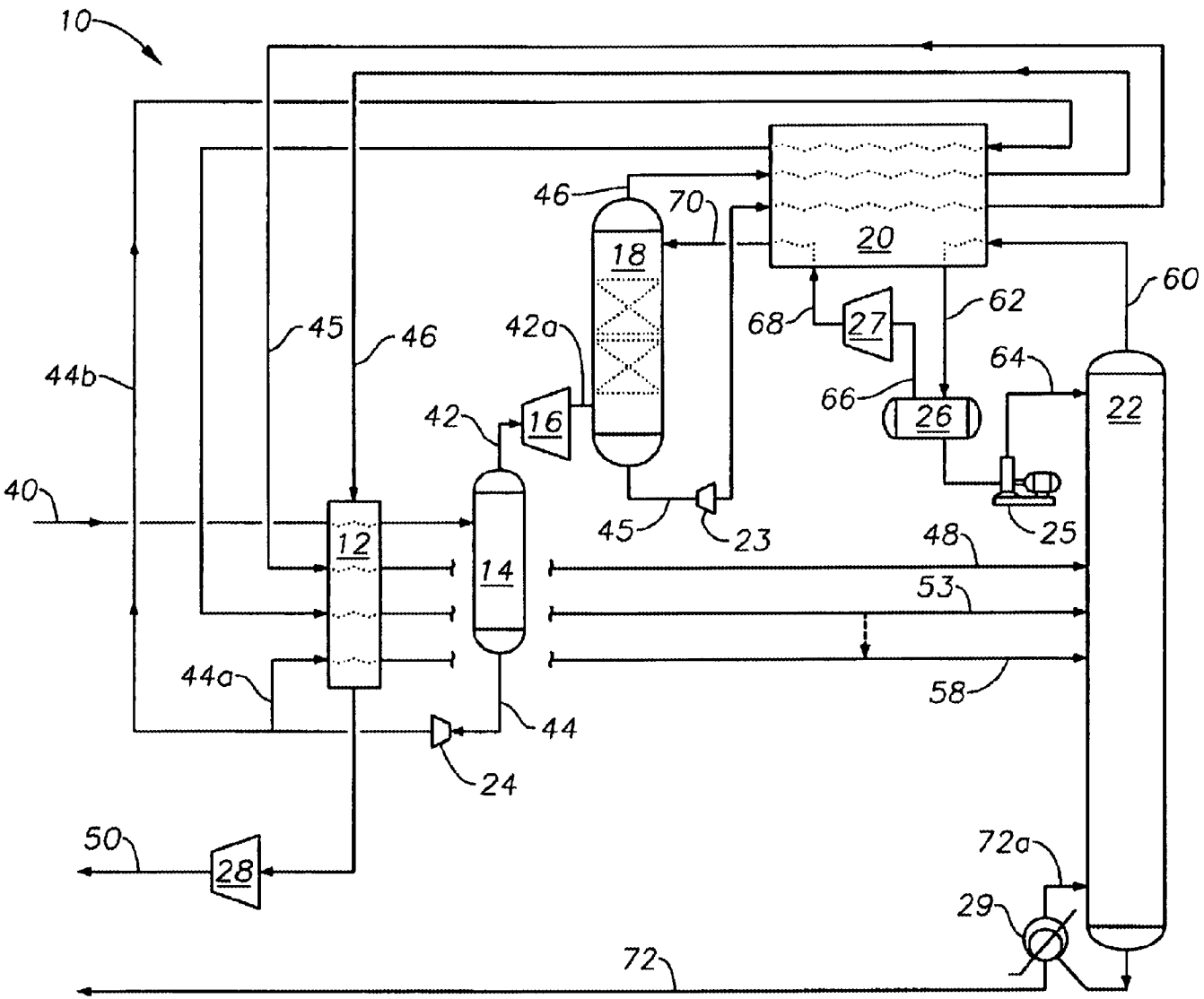
FIG. 1 is a simplified flow diagram of a cryogenic gas separation process that incorporates the improvements of the present invention and configured for improved recovery of $C_3$ compounds and heavier compounds.

Natural gas and hydrocarbon streams, such as refinery and petrochemical plants' off gases, include methane, ethylene, ethane, propylene, propane, butane and heavier compounds in addition to other impurities. Pipeline sales of natural gas is comprised mostly of methane with varying amounts of other light compounds, such as hydrogen, ethylene and propylene. Ethane, ethylene and heavier compounds, referred to as natural gas liquids, must be separated from such natural gas streams to yield natural gas for pipeline sales. A typical lean natural gas stream contains approximately 92% methane, 4% ethane and other $C_2$ compounds, 1% propane and other $C_3$ compounds, and less than 1% of $C_4$ and heavier compounds in addition to small amounts of nitrogen, carbon dioxide and sulfur-containing compounds, based on molar concentrations. The amounts of $C_2$ compounds and heavier compounds and other natural gas liquids are higher for rich natural gas streams. In addition, refinery gas may include other gases, including hydrogen, ethylene and propylene.

As used herein, the term "inlet gas" means a hydrocarbon gas that is substantially comprised of 85% by volume methane, with the balance being $C_2$ compounds, $C_3$ compounds and heavier compounds as well as carbon dioxide, nitrogen and other trace gases. The term "$C_2$ compounds" means all organic compounds having two carbon atoms, including aliphatic species such as alkanes, olefins, and alkynes, particularly, ethane, ethylene, acetylene and the like. The term "$C_3$ compounds" means all organic compounds having three carbon atoms, including aliphatic species such as alkanes, olefins, and alkynes, and, in particular, propane, propylene, methyl-acetylene and the like. The term "heavier compounds" means all organic compounds having four or more carbon atoms, including aliphatic species such as alkanes, olefins, and alkynes, and, in particular, butane, butylene, ethyl-acetylene and the like. The term "lighter compounds" when used in connection with $C_2$ or $C_3$ compounds means organic compounds having less than two or three carbon atoms, respectively. As discussed herein, the expanding steps, preferably by isentropic expansion, may be effectuated with a turbo-expander, Joules-Thompson expansion valves, a liquid expander, a gas or vapor expander or the like. Also, the expanders may be linked to corresponding staged compression units to produce compression work by substantially isentropic gas expansion.

The detailed description of preferred embodiments of this invention is made with reference to the liquefaction of a pressurized inlet gas, which has an initial pressure of about 700 psia at ambient temperature. Preferably, the inlet gas will have an initial pressure between about 500 to about 1500 psia at ambient temperature.

Referring now to FIGS. 1 through 5 of the drawings, a preferred embodiment of the cryogenic gas separation process of the present invention is shown configured for improved recovery of C3 compounds and heavier compounds. This process utilizes a two-column system that includes an absorber column and a sequentially-configured or downstream fractionation column. Absorber 18 is an absorber column having at least one vertically spaced tray, one or more packed beds, any other type of mass transfer device, or a combination thereof. Absorber 18 is operated at a pressure P that is substantially greater than and at a predetermined differential pressure from a sequential configured or downstream fractionation column. The predetermined differential pressure between the high pressure absorber and the fractionation column is about 50 psi–350 psi in all embodiments of the invention. An example of this differential pressure would be if the absorber pressure is 800 psig, then the fractionation column pressure could be 750 psig to 450 psig, depending upon the differential pressure chosen. The preferable differential pressure is typically 50 psi. Fractionation column 22 is a fractionation column having at least one vertically spaced chimney tray, one or more packed bed or a combination thereof.

A pressurized inlet hydrocarbon gas stream 40, preferably a pressurized natural gas stream, is introduced to cryogenic gas separation process 10 for improved recovery of $C_3$ compounds and heavier compounds at a pressure of about 900 psia and ambient temperature. Inlet gas stream 40 is typically treated in a treatment unit (not shown) to remove acid gases, such as carbon dioxide, hydrogen sulfide, and the like, by known methods such as desiccation, amine extraction or the like. In accordance with conventional practice in cryogenic processes, water has to be removed from inlet gas streams to prevent freezing and plugging of the lines and heat exchangers at the low temperatures subsequently encountered in the process. Conventional dehydration units are used which include gas desiccants and molecular sieves.

Treated inlet gas stream 40 is cooled in front end exchanger 12 by heat exchange contact with a cooled absorber overhead stream 46, absorber bottom stream 45 and cold separator bottom stream 44. In all embodiments of this invention, front end exchanger 12 may be a single multi-path exchanger, a plurality of individual heat exchangers, or combinations thereof. The high pressure cooled inlet gas stream 40 is supplied to cold separator 14 where a first vapor stream 42 is separated from a first liquid stream 44.

The first vapor stream 42 is supplied to expander 16 where this stream is isentropically expanded to the operating pressure P1 of absorber 18. The first liquid stream 44 is expanded in expander 24 and then supplied to front end exchanger 12 and warmed. Stream 44 is then supplied to a mid-column feed tray of fractionation column 22 as a first fractionation feed stream 58. Expanded first vapor stream 42*a* is supplied to a mid-column or lower feed tray of absorber 18 as a first absorber feed stream.

Absorber 18 is operated at a pressure P1 that is substantially greater than and at a predetermined differential pressure from a sequential configured or downstream fractionation column. The absorber operating pressure P may be selected on the basis of the richness of the inlet gas as well as the inlet gas pressure. For lean inlet gas having lower NGL content, the absorber may be operated at relatively high pressure that approaches inlet gas pressure, preferably above about 500 psia. In this case, the absorber produces a very high pressure overhead residue gas stream that requires less recompression duty for compressing such gas to pipeline specifications. For rich inlet gas streams, the absorber pressure P is from at least above 500 psia. In absorber 18, the rising vapors in first absorber feed stream 42 a are at least partially condensed by intimate contact with falling liquids from absorber feed stream 70 thereby producing an absorber overhead stream 46 that contains substantially all of the methane, $C_2$ compounds and lighter compounds in the expanded vapor stream 42*a*. The condensed liquids descend down the column and are removed as absorber bottom stream 45, which contains a major portion of the $C_3$ compounds and heavier compounds.

Absorber overhead stream 46 is removed to overhead exchanger 20 and is warmed by heat exchange contact with absorber bottom stream 45, fractionation column overhead stream 60 and compressed second vapor stream 68. Compressed second vapor stream 68 contains a major portion of the methane in the fractionation feed stream and second fractionation feed stream. When the heavy key component is $C_3$ compounds and heavier compounds, then the compressed second vapor stream 68 contains a major portion of the $C_2$ compounds in the fractionation feed stream and second fractionation feed stream. Stream 45 is expanded and cooled in expander 23 prior to entering overhead exchanger 20. (Alternatively, a portion of first liquid stream 44 may be supplied to the overhead exchanger 20 as stream 44*b* to provide additional cooling to these process streams before being supplied to the front end exchanger 12 as stream 53. Upon leaving overhead exchanger 20, stream 53 can either be fed into the fractionation column 22 or combined with stream 58.) Absorber overhead stream 46 is further warmed in front end exchanger 12 and compressed in booster compressor 28 to a pressure of above about 800 psia or pipeline specifications to form residue gas 50. Residue gas 50 is a pipeline sales gas that contains substantially all of the methane and $C_2$ compounds in the inlet gas, and a minor portion of $C_3$ compounds and heavier compounds. Absorber bottom stream 45 is further cooled in front end exchanger 12 and supplied to a feed tray of a middle portion of fractionation column 22 as a second fractionation column feed stream 48. By virtue of the predetermined high pressure differential between absorber 18 and fractionation column 22, the absorber bottom stream 48 may be supplied to the fractionation column 22 without a pump.

Fractionation column 22 is operated at a pressure P2 that is lower than and at a predetermined differential pressure DP from a sequential configured or upstream absorber column, preferably where P2 is above about 400 psia for such gas streams. For illustrative purposes, if P2 is 400 psia and DP is 150 psi, then P1 is 550 psia. The fractionation column feed rates, as well as temperature and pressure profiles, may be selected to obtain an acceptable separation efficiency of the compounds in the liquid feed streams, as long as the set differential pressure between the fractionation column and the absorber is maintained. In fractionation column 22, first feed stream 48 and second feed stream 58 are supplied to one or more mid-column feed trays to produce a bottom stream 72 and an overhead stream 60. The fractionation column bottom stream 72 is cooled in bottoms exchanger 29 to produce an NGL product stream that contains substantially all of the heavy key components and heavies. A portion of fractionation column bottom stream 72*a* can be refluxed back to fractionation column 22 as shown in FIGS. 1–5.

Figure 2:
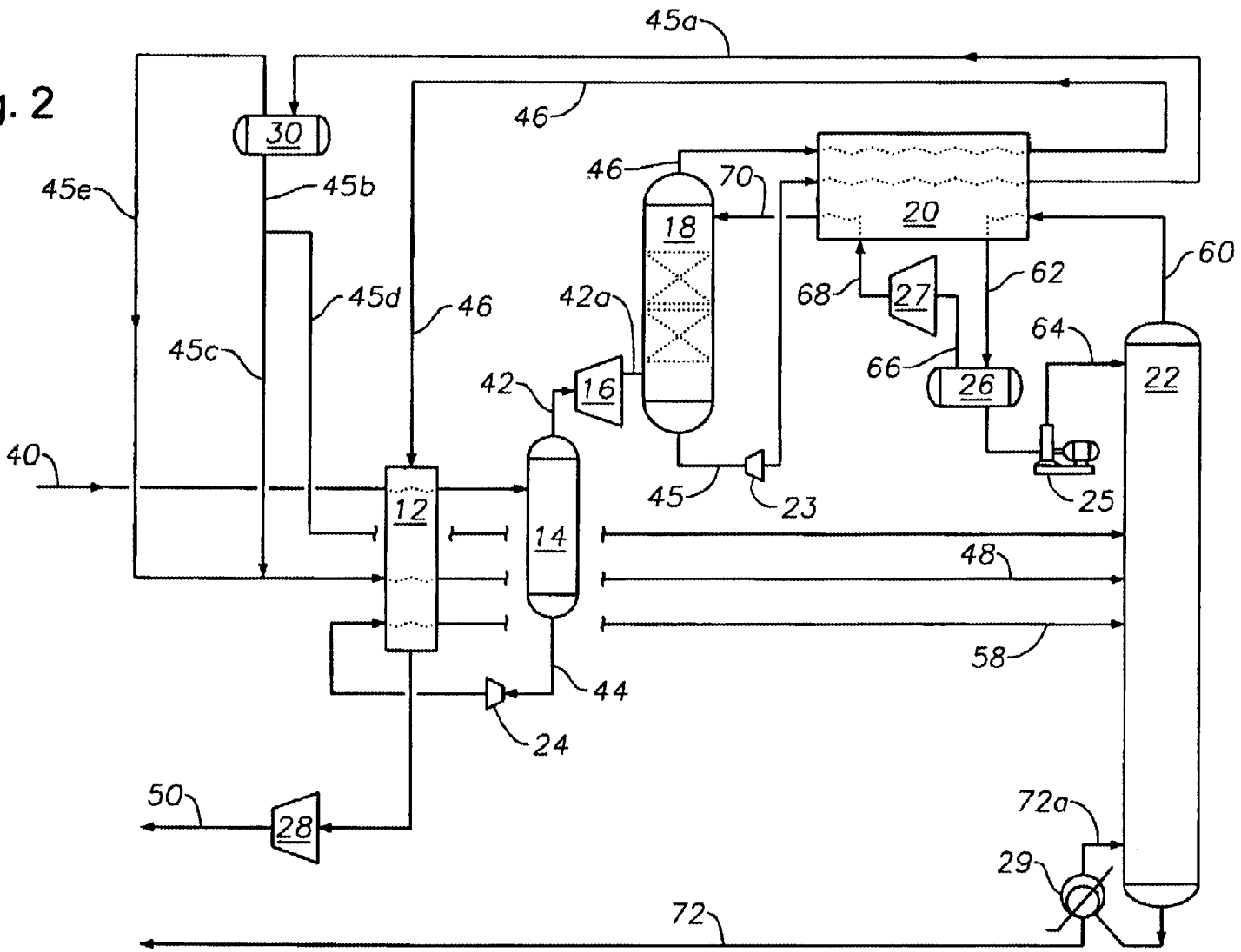
FIG. 2 is an alternate embodiment of the process in FIG. 1 wherein a third feed stream is fed to the fractionation column.
Figure 3:
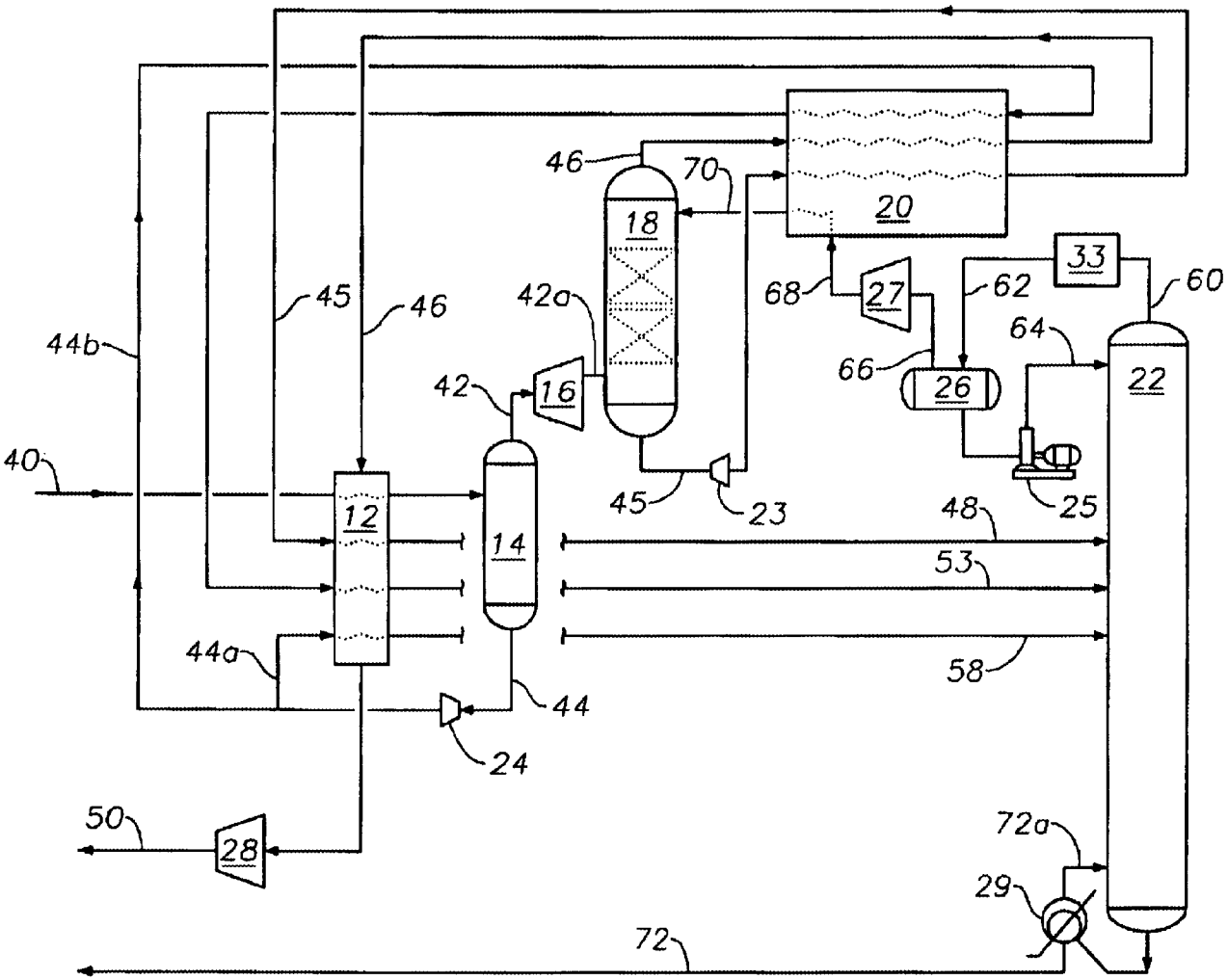
FIG. 3 is an alternate embodiment of the process in FIG. 1 that includes a mechanical refrigeration system.

Fractionation column overhead stream 60 is at least partially condensed in overhead condenser 20 by heat exchange contact with absorber overhead and bottom streams 46, 45 and/or first liquid portion stream 53. The at least partially condensed overhead stream 62 is separated in overhead separator 26 to produce a second vapor stream 66 that contains a major portion of methane, C2 and lighter compounds and a liquid stream that is returned to fractionation column 22 as fractionation reflux stream 64. Fractionation reflux stream 64 can be pumped to fractionation column 22 by using pump 25 as shown in FIGS. 1–3. The second vapor stream 66 is supplied to overhead compressor 27 and compressed essentially to the operating pressure P of absorber 18. The compressed second vapor stream 68 is at least partially condensed in overhead exchanger 20 by heat exchange contact with absorber overhead and bottom streams 46, 45 and/or first liquid portion stream 53. The condensed and compressed second vapor stream is supplied to absorber 18 as reflux stream 70. The compressed second vapor stream contains a major portion of the methane in the fractionation feed streams. When the heavy key component is C3 compounds and heavier compounds, then the compressed second vapor stream contains a major portion of the C2 compounds in the fractionation feed streams.

By way of example, the molar flow rates of the pertinent streams in FIG. 1 are shown in Table I as follows:

TABLE I

Stream Flow Rates - Lb. Moles/Hr.

| Stream | $CO_2$ | $N_2$ | $C_1$ | $C_2$ | $C_3$ | $C_{4+}$ | Total | Pressure psia |
|---|---|---|---|---|---|---|---|---|
| 40 | 123 | 114 | 18,777 | 2,237 | 806 | 635 | 22,692 | 1,265 |
| 42 | 111 | 111 | 17,696 | 1,901 | 586 | 273 | 20,677 | 1,255 |
| 48 | 29 | 3 | 1,663 | 1,001 | 586 | 273 | 3,554 | 483 |
| 50 | 123 | 114 | 18,777 | 2,184 | 8 | 0 | 21,206 | 1,265 |
| 58 | 12 | 3 | 1,081 | 336 | 221 | 362 | 2,016 | 453 |
| 60 | 41 | 6 | 2,744 | 1,284 | 8 | 0 | 4,084 | 425 |
| 70 | 41 | 6 | 2,744 | 1,284 | 8 | 0 | 4,084 | 558 |
| 72 | 0 | 0 | 0 | 53 | 798 | 635 | 1,486 | 435 |

FIG. 2 depicts a variation to the process in FIG. 1. Here, the absorber bottom stream 45 is expanded in expander 23 and at least partially condensed in overhead exchanger 20, forming stream 45*a*. Stream 45*a* consists of a liquid and a vapor hydrocarbon phase, which is separated in vessel 30. The liquid phase stream 45*b* is split into two streams, 45*c* and 45*d*. Stream 45*d* is fed directly to the fractionation column 22 without any further heating. Stream 45*c* can very between 0% to 100% of stream 45*b*. The vapor stream 45*e* from vessel 30 is combined with stream 45*c* and is further heated in front end exchanger 12 by heat exchange contact with inlet gas stream 40 before entering the fractionation column 22.

Figure 4:
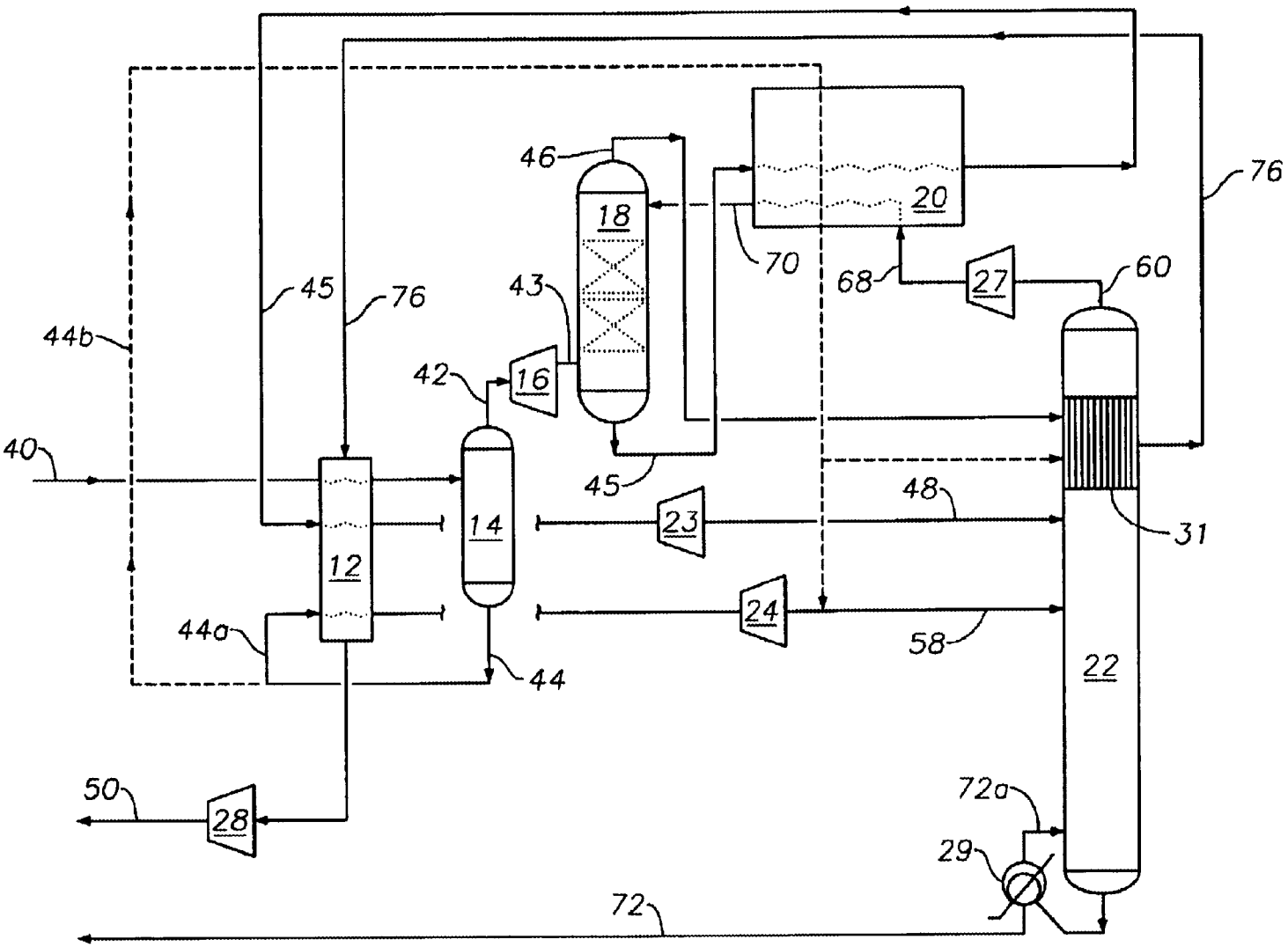
FIG. 4 is an alternate embodiment of the process in FIG. 3 that includes an internal fractionation column condenser.
Figure 5:
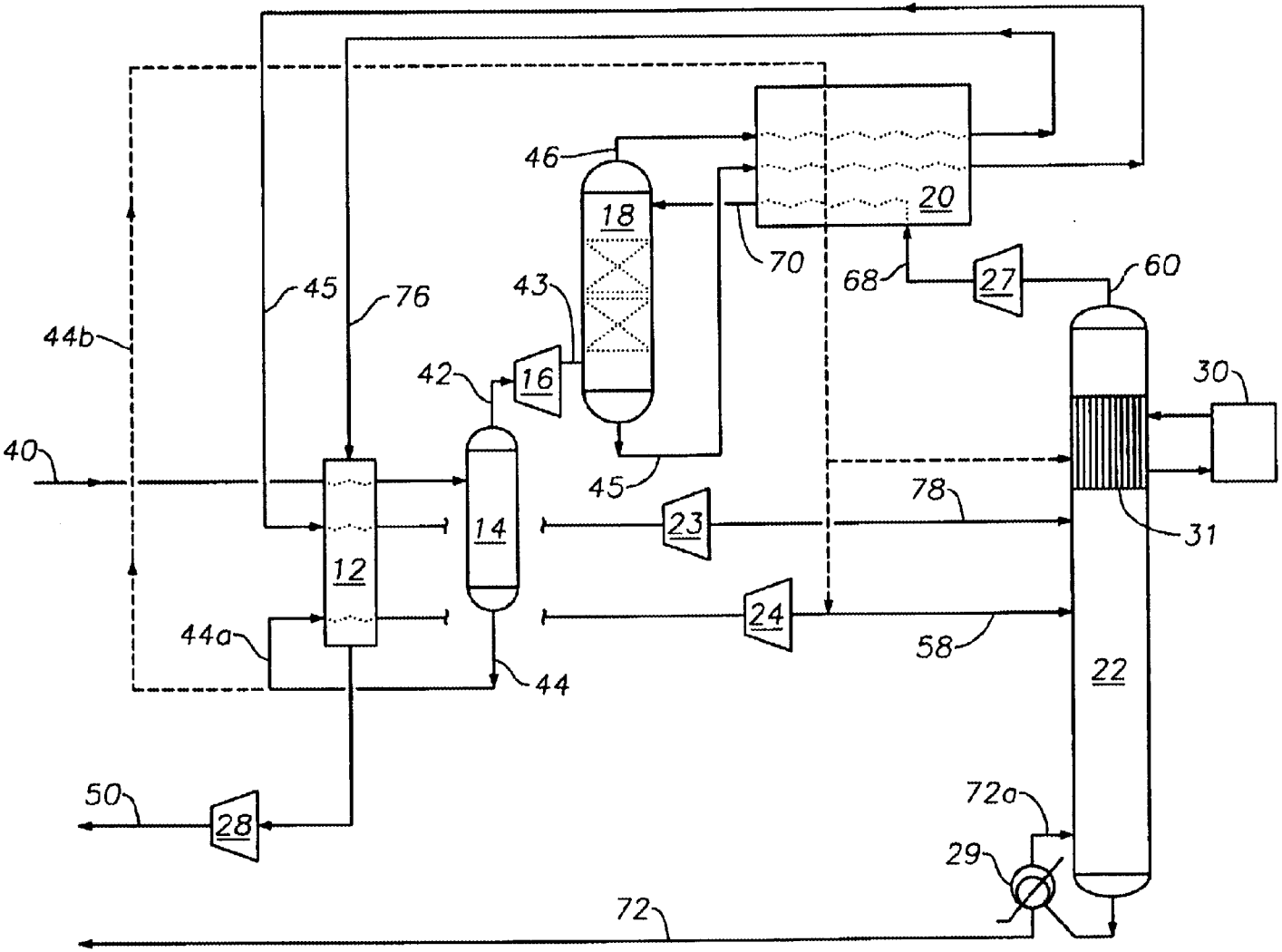
FIG. 5 is an alternate embodiment of the process in FIG. 4 that includes improved heat integration through the use of a mechanical refrigeration system.

FIGS. 3 through 5 show alternate preferred embodiments of this invention. In FIG. 3, a mechanical refrigeration system 33 is used to at least partially condense fractionation column overhead stream 60 to produce an at least partially condensed stream 62. The at least partially condensed stream 62 is separated in separator 26, as noted above. Such mechanical refrigeration systems include propane refrigerant-type systems.—In FIG. 4, an internal condenser 31 within fractionation column 22 is used to at least partially condense fractionation column overhead using stream 46. The absorber overhead stream 46 is warmed by heat exchange in the internal condenser and emerges as internal condenser outlet stream 76, which is warmed by heat exchange contact with other process streams in front end exchanger 12. FIG. 5 depicts the same process shown in FIG. 4, but with the addition of the mechanical refrigeration system from the process depicted in FIG. 3, which can be used as an external refrigeration system for the internal condenser. In this embodiment, absorber bottoms stream 45 is cooled in overhead exchanger 20 and front end exchanger 12 and then expanded in expander 23 prior to being sent to fractionation column 22 as a mid column feed stream 78. In all embodiments, the fractionation bottom stream contains substantially all of the heavies.

Figure 6:
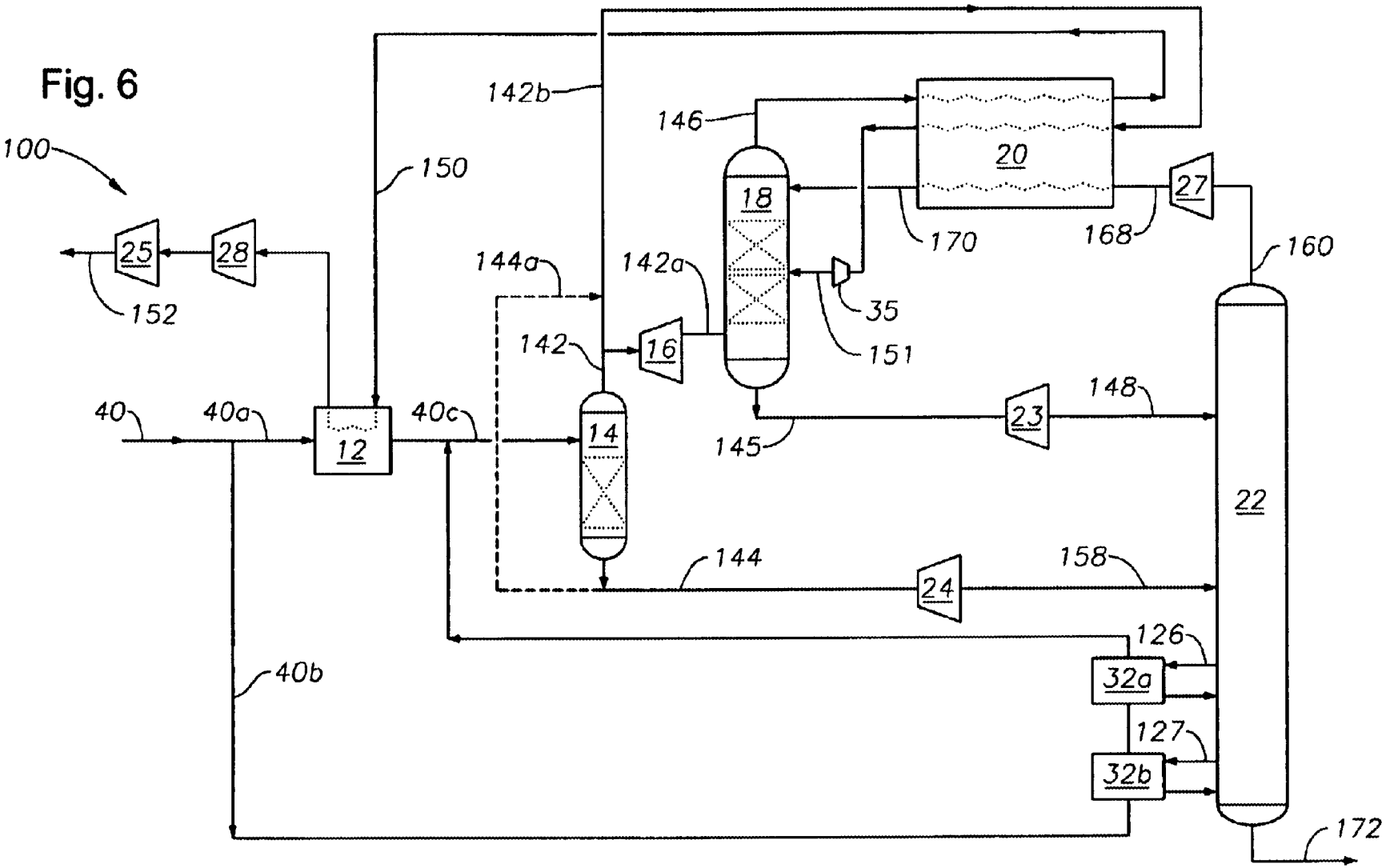
FIG. 6 is a simplified flow diagram of a cryogenic gas separation process that incorporates the improvements of the present invention and is configured for improved recovery of $C_2$ compounds and heavier compounds.
Figure 7:
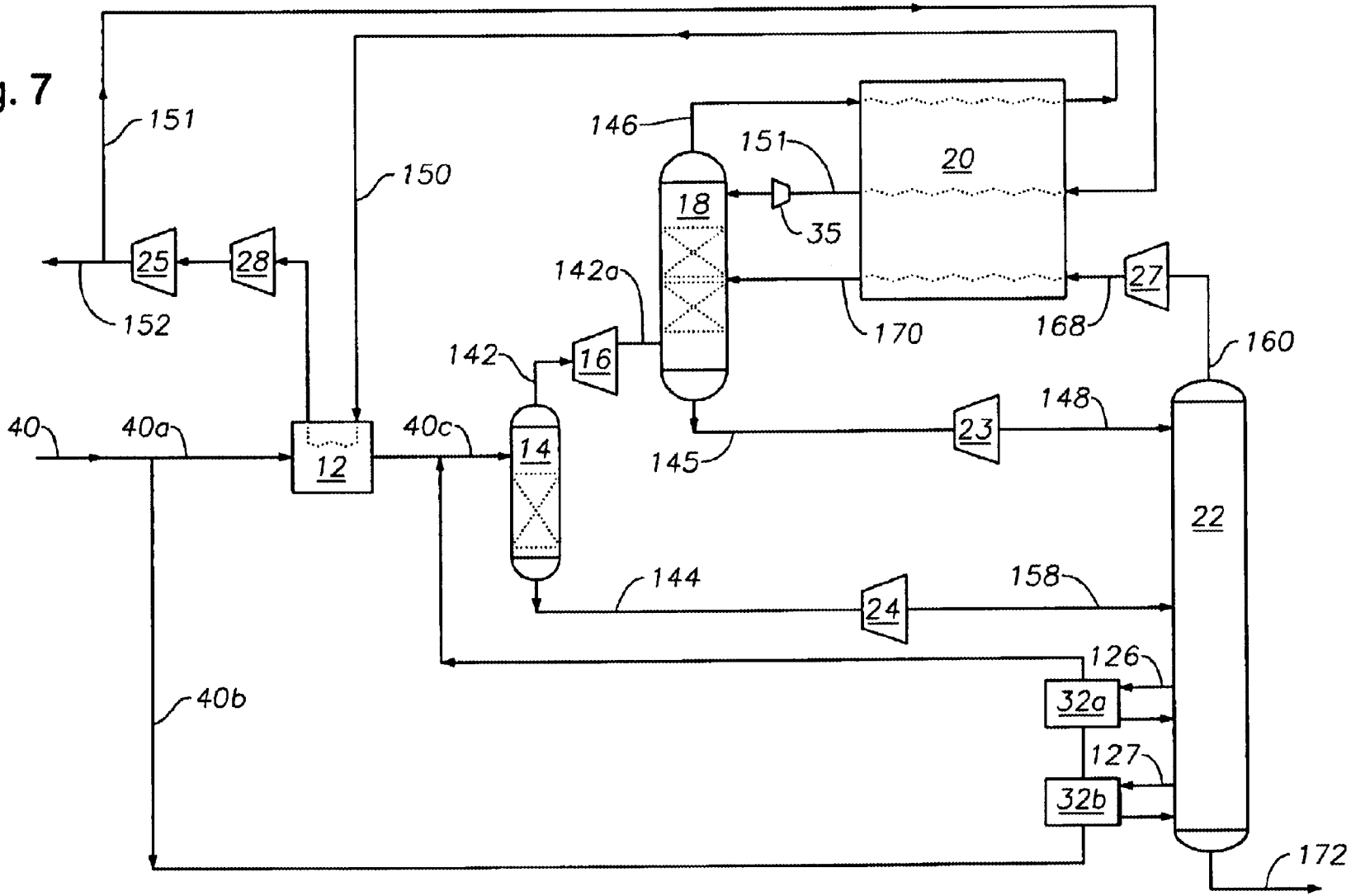
FIG. 7 is an alternate embodiment of this invention for improved recovery of $C_2$ compounds and heavier compounds that includes supplying the high pressure absorber with recycled residue gas reflux and/or feed streams and a split inlet gas feed stream.
Figure 8:
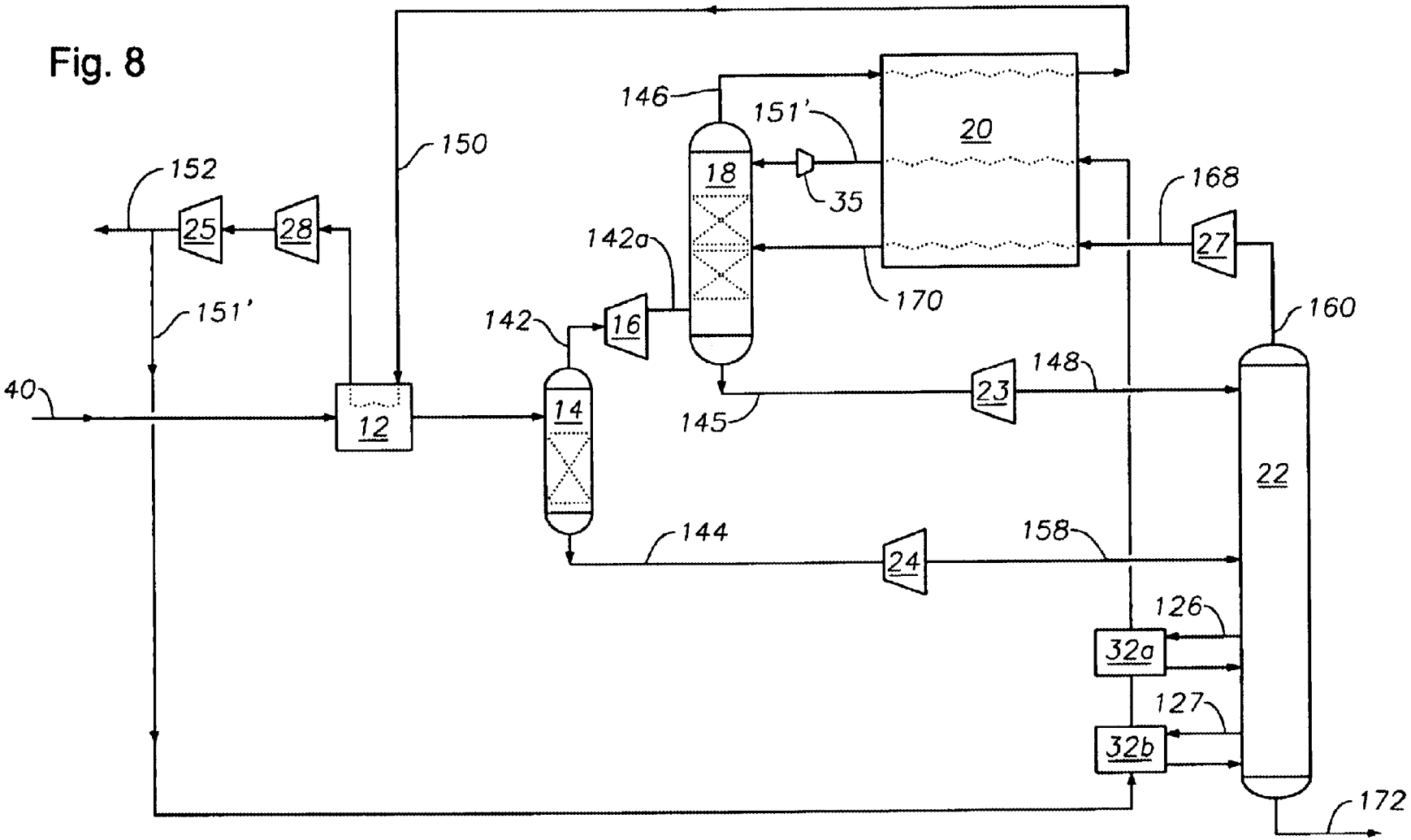
FIG. 8 is an alternate embodiment of the process in FIG. 7 that includes supplying the high pressure absorber with recycle gas reflux and/or feed streams, but without the split feed inlet gas streams.

FIGS. 6 through 8 show still another preferred embodiment of the cryogenic gas separation process of the present invention, configured for improved recovery of $C_2$ compounds and heavier compounds. This process utilizes a similar two-column system, as noted above. Pressurized inlet hydrocarbon gas stream 40, preferably a pressurized natural gas stream, is introduced to cryogenic gas separation process 100 operating in $C_2$ recovery mode at a pressure of about 900 psia and ambient temperature. Treated inlet gas 40 is divided into to streams 40*a*, 40*b*. Inlet gas stream 40*a* is cooled in front end exchanger 12 by heat exchange contact with stream 150, which is formed by warming absorber overhead stream 146 in overhead exchanger 20.

Inlet gas stream 40*b* is used to provide heat to side reboilers 32*a*, 32*b* of fractionation column 22 and is cooled thereby. Stream 40*b* is first supplied to lower side reboiler 32*b* for heat exchange contact with liquid condensate 127 that is removed from a tray below the lowest feed tray of fractionation column 22. Liquid condensate 127 is thereby warmed and redirected back to a tray below that from which it was removed. Stream 40*b* is next supplied to upper side reboiler 32*a* for heat exchange contact with liquid condensate 126 that is removed from a tray below the lowest feed tray of fractionation column 22 but above the tray from which liquid condensate 127 was removed. Liquid condensate 126 is thereby warmed and redirected back to a tray below that from which it was removed, but above the tray from which liquid condensate 127 was removed. Stream 40*b* is cooled and at least partially condensed and then recombined with cooled stream 40*a*. The combined streams 40*a*, 40*b* are supplied to cold separator 14 that separates these streams, preferably, by flashing off a first vapor stream 142 from a first liquid stream 144. First liquid stream 144 is expanded in expander 24 and supplied to a mid-column feed tray of fractionation column 22 as a first fractionation feed stream 158. A slip stream 144*a* from first liquid stream 144 can be combined with second expanded vapor stream 142*b* and supplied to overhead exchanger 20.

At least a portion of first vapor stream 142 is expanded in expander 16 and then supplied to absorber 18 as an expanded vapor stream 142*a*. The remaining portion of first vapor stream 142, second expanded vapor stream 142*b*, is supplied to overhead condenser 20 and is at least partially condensed by heat exchange contact with other process streams, noted below. The at least partially condensed second expanded vapor stream 142*b* is supplied to a middle region of absorber 18 after being expanded in expander 35, preferably as second absorber feed stream 151, which is rich in $C_2$ compounds and lighter compounds.

Absorber 18 produces an overhead stream 146 and a bottom stream 145 from the expanded vapor stream 142*a*, a second absorber feed stream 151, and absorber feed stream 170.

In absorber 18, the rising vapors in the expanded vapor stream 142*a* and second absorber feed stream 151, discussed below, are at least partially condensed by intimate contact with falling liquids from absorber feed stream 170 thereby producing an absorber overhead stream 146 that contains substantially all of the methane and lighter compounds in the expanded vapor stream 142*a* and second expanded vapor stream 142*b*. The condensed liquids descend down the column and are removed as absorber bottom stream 145 that contains a major portion of the $C_2$ compounds and heavier compounds.

Absorber overhead stream 146 is removed to overhead exchanger 20 and is warmed by heat exchange contact with second expanded vapor stream 142*b* and compressed second vapor stream 168. Absorber overhead stream 146 is further warmed in front end exchanger 12 as stream 150 and compressed in expander-booster compressors 28 and 25 to a pressure of at least above about 800 psia or pipeline specifications to form residue gas 152. Residue gas 152 is a pipeline sales gas that contains substantially all of the methane in the inlet gas and a minor portion of $C_2$ compounds and heavier compounds. Absorber bottom stream 145 is expanded and cooled in expansion means, such as expansion valve 23, and supplied to a mid-column feed tray of fractionation column 22 as a second fractionation feed stream 148. By virtue of the high pressure differential between absorber 18 and fractionation column 22, the absorber bottom stream 145 may be supplied to the fractionation column 22 without a pump.

Fractionation column 22 is operated at a pressure that is substantially lower than of absorber 18, preferably above about 400 psia. The fractionation column feed rates as well as temperature and pressure profiles may be selected to obtain an acceptable separation efficiency of the compounds in the liquid feed streams, as long as the set differential pressure between the fractionation column and the absorber is maintained, i.e., 150 psi. First feed stream 158 and second fractionation feed stream 148 are supplied at one or more feed trays near a middle portion of fractionation column 22 to produce a bottom stream 172 and an overhead stream 160. The fractionation column bottom stream 172 can be cooled to produce an NGL product stream that contains a majority of the heavy key component and heavies.

Fractionation column overhead stream 160 is supplied to overhead compressor 27 and compressed essentially to the operating pressure P of absorber 18 as compressed second vapor stream 168. Compressed second vapor stream 168 is at least partially condensed in overhead condenser 20 by heat exchange contact with absorber overhead stream 146 and second expanded vapor stream 142*b*. The at least partially condensed overhead stream 168 is sent to absorber 18 as second absorber feed stream 151.

By way of example, the molar flow rate of the pertinent streams of FIG. 6 are shown in Table II as follows.

TABLE II

Stream Flow Rates - Lb. Moles/Hr.

| Stream | $N_2$ | $CO_2$ | $C_1$ | $C_2$ | $C_3$ | $C_{4+}$ | Total | Pressure, psia |
|---|---|---|---|---|---|---|---|---|
| 40 | 82.1 | 287.1 | 16,913.0 | 1,147.2 | 520.8 | 186.9 | 19,137.0 | 1290 |
| 142 | 82.1 | 287.1 | 16,913.0 | 1,147.2 | 520.8 | 186.9 | 19,137.0 | 1270 |
| 142a | 60.6 | 212.1 | 12,494.1 | 847.4 | 384.7 | 138.0 | 14,137.0 | 550 |
| 142b | 21.4 | 75.0 | 4,418.9 | 299.7 | 136.1 | 48.8 | 5,000.0 | 1270 |
| 148 | 5.1 | 192.7 | 3,440.9 | 1,078.7 | 524.3 | 187.2 | 5,428.8 | 375 |
| 151 | 5.1 | 49.9 | 3,421.1 | 101.3 | 7.2 | 0.4 | 3,584.9 | 550 |
| 152 | 82.1 | 144.2 | 16,893.1 | 169.7 | 3.7 | 0.1 | 17,293.0 | 1315 |
| 160 | 5.1 | 49.9 | 3,421.4 | 101.3 | 7.2 | 0.4 | 3,585.1 | 360 |
| 170 | 21.4 | 75.0 | 4,418.9 | 299.7 | 136.1 | 48.8 | 5,000.0 | 550 |
| 172 | — | 142.8 | 19.5 | 977.4 | 517.1 | 186.8 | 1,843.7 | 365 |

Figure 6A:
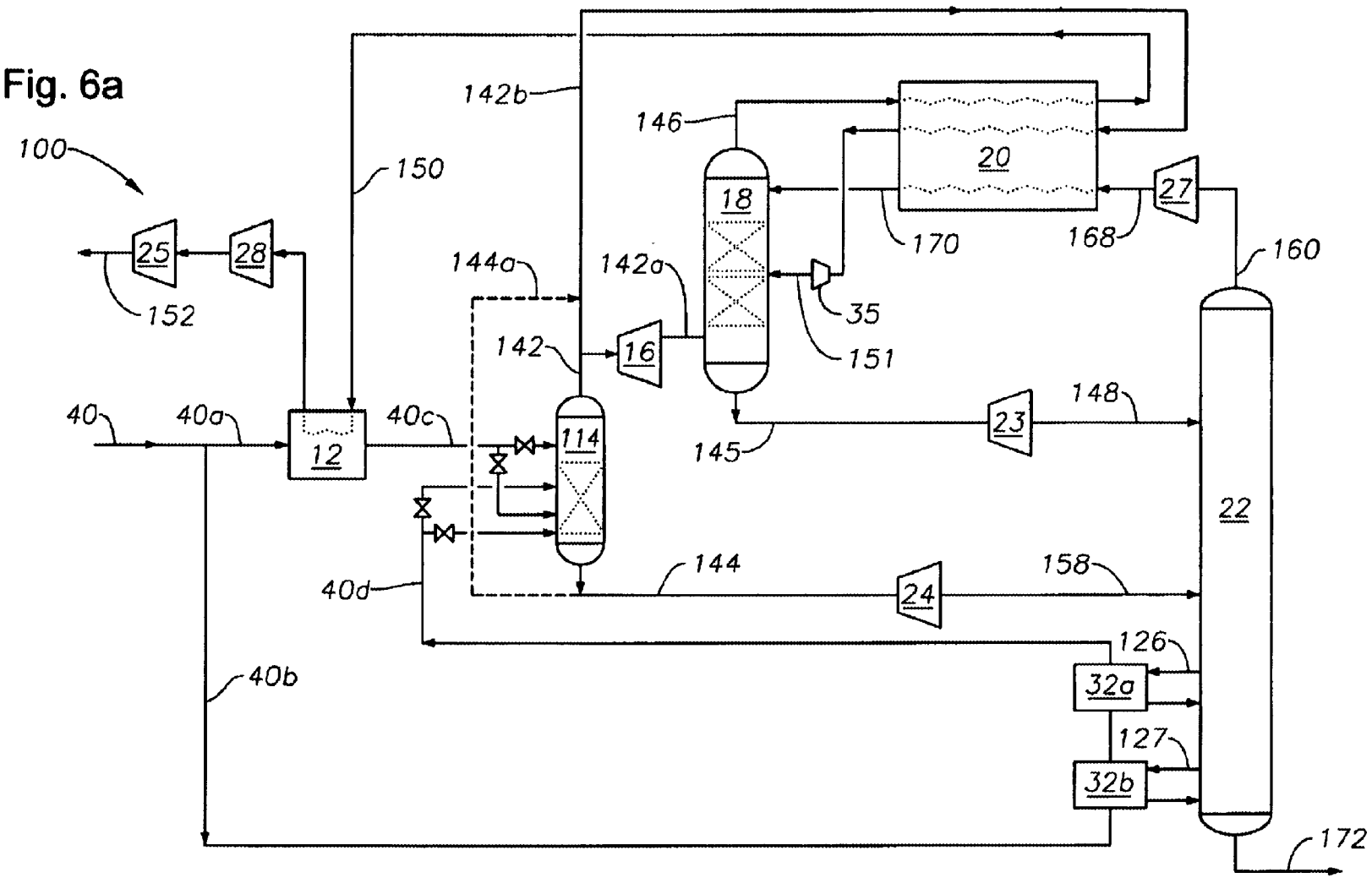
FIG. 6*a* is an alternate embodiment of the process in FIG. 6 that includes a split feed stream that supplies the high pressure absorber and the fractionation tower.

FIGS. 6*a* through 8 show other preferred embodiments of the cryogenic gas separation process for improved recovery of C2 compounds and heavier compounds in which the high pressure absorber receives streams rich in C2 compounds and lighter compounds to improve separation efficiency. FIG. 6*a* contains another embodiment of the process shown in FIG. 6. In FIG. 6*a*, a cold absorber 114 with one or more mass transfer stages is used instead of a cold separator 14. Feed stream 40 is split into two separate feed streams 40*a* and 40*b* in this process variation. Stream 40*a* is cooled in front end exchanger 12 by heat exchange contact with the absorber overheads stream 150 and emerges as stream 40*c*. Stream 40*b* is cooled in the reboilers 32*a* and 32*b* by heat exchange contact with streams 126 and 127 respectively and emerges as stream 40*d*. The colder of the two streams, 40*c* and 40*d*, is fed to the top of the cold absorber 14 with the warmer of the two streams, 40*c* and 40*d*, being fed to the bottom of the cold absorber 14. Additionally, at least a portion of the first liquid stream 144 can be split as stream 144*a* and combined with the second expanded vapor stream 142*b* discussed above.

FIG. 7 depicts an alternative to the cryogenic $C_2$+ recovery process shown in FIG. 6. Here, the first vapor stream 142 from the cold separator 14 passes through expander 16 as expanded vapor stream 142*a* without splitting prior to entering the expander 16. Expanded vapor stream 142*a* is fed to the lower portion of absorber 18 in its entirety, instead of being split into expanded vapor stream 142*a* and second expanded vapor stream 142*b*. The absorber 18 also is supplied with a second absorber feed stream 151. The second absorber feed stream 151 is produced by taking a slip stream of the residue gas 152, heating it in overhead exchanger 20, expanding it in expander 35 and supplying it to absorber 18 as second absorber feed stream 151. The absorber feed stream 170 remains the same as in FIG. 6.

Figure 7A:
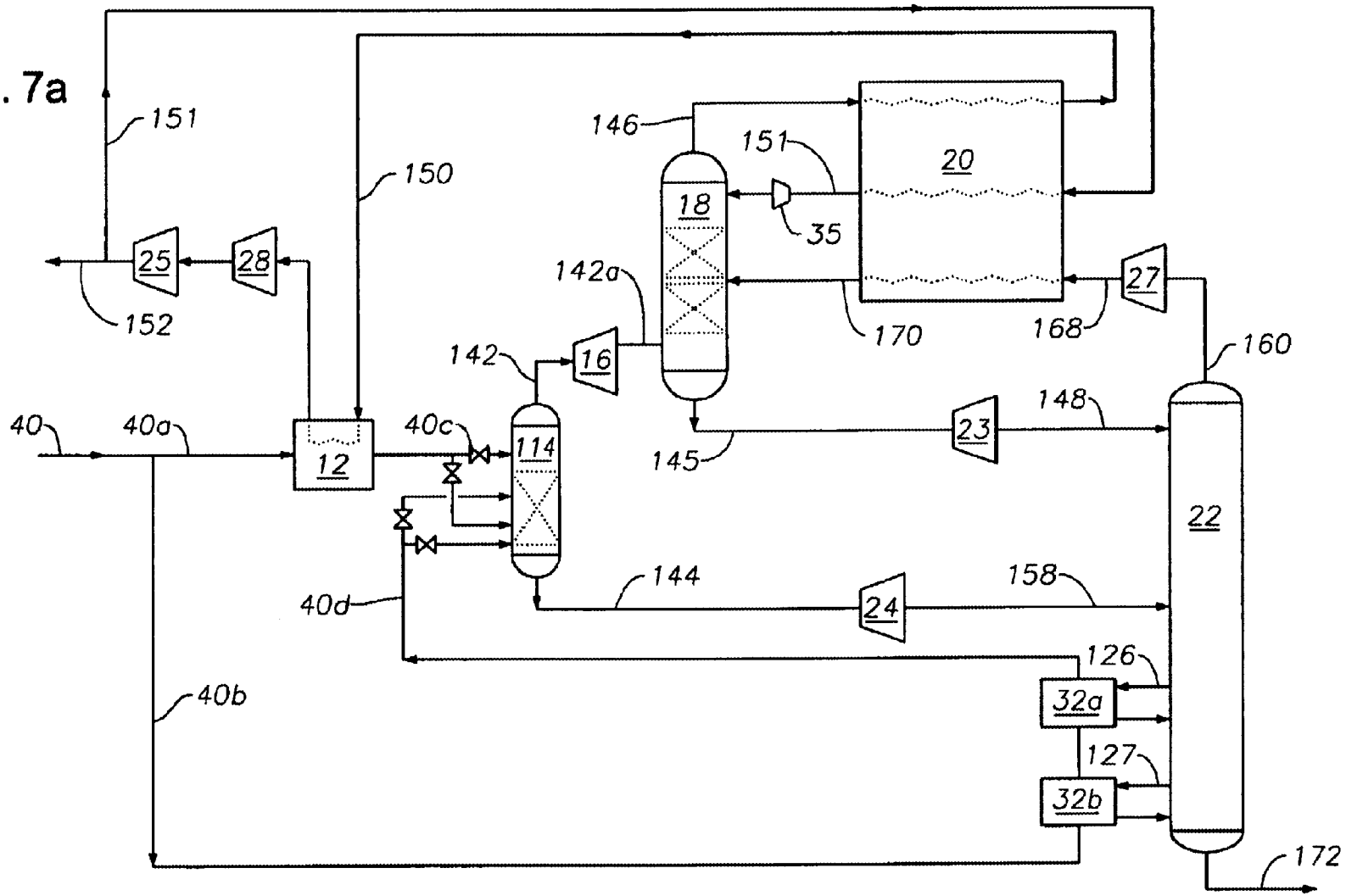
FIG. 7*a* is an alternate embodiment of the process in FIG. 7 that includes a cold absorber and supplying the cold absorber with split inlet gas feed streams.

FIG. 7*a* contains another embodiment of the process shown in FIG. 7. In FIG. 7*a*, a cold absorber 114 with one or more mass transfer stages is used instead of a cold separator 14. Feed stream 40 is split into two separate feed streams 40*a* and 40*b* in this particular embodiment of the process. Stream 40*a* is cooled in front end exchanger 12 by heat exchange contact with the absorber overhead stream 150 and emerges as stream 40*c*. Stream 40*b* is cooled in the reboilers 32*a* and 32*b* by heat exchange contact with streams 126 and 127 respectively and emerges as stream 40*d*. The colder of the two streams, 40*c* and 40*d*, is fed to the top of the cold absorber 114 with the warmer of the two streams, 40*c* and 40*d*, being fed to the bottom of the cold absorber 114.

FIG. 8 depicts a further embodiment of the C2+ recovery process. In this particular process embodiment, the inlet gas stream 40 is cooled in front end exchanger 12 and fed to cold separator 14. The first vapor stream 142 is expanded in expander 16 and fed to absorber 18 as expanded vapor stream 142*a*. Expanded vapor stream 142*a* is fed to the lower portion of absorber 18 in its entirety, as opposed to being split into streams 142*a* and 142*b* as in previously discussed embodiments. Two other absorber feed streams exist in the present embodiment of the process. Fractionation column overhead vapor stream 160 is compressed and expanded in compressor 27 to the same pressure as the absorber 18 and exits as compressed second vapor stream 168. Fractionation bottom stream contains substantially all of the heavy key component. Compressed second vapor stream 168 is at least partially condensed in overhead exchanger 20 and fed to absorber 18 as second absorber feed stream 151. A second expanded vapor stream 151' of residue gas stream 152 is heated in reboilers 32*a* and 32*b*, at least partially condensed in overhead exchanger 20, and expanded to the same pressure as the absorber 18 in expander 35, and fed to the absorber 18.

There are significant advantages to the present invention wherein the absorber operating pressure is substantially greater than and at a predetermined differential pressure from a sequentially configured or downstream fractionation column for recovery of $C_2$ compounds and/or $C_3$ compounds and heavier compounds. First, the recompression horsepower duty may be decreased, thereby increasing gas processing throughput. This is particularly true for high pressure inlet gas. Recompression horsepower duty is mostly attributable to expansion of the inlet gas to the lower, operating pressure of the absorber. The residue gas produced in the absorber is then recompressed to pipeline specifications. By increasing the absorber operating pressure, less gas compression is needed. In addition to the lower recompression horsepower duty requirements for the gases, other advantages exist. The overhead compressor controls the pressure of the fractionation column 22, which prevents the fractionation column from pressuring up, particularly during startup of the process. The absorber pressure is allowed to rise and acts like a buffer to protect the fractionation column, which increases the safety in operating the fractionation column. Since the fractionation column of the current invention can be designed for operating pressures lower than the prior art, initial capital costs for the column are reduced. Another advantage over the prior art is that the overhead compressor will maintain the column within the proper operating range, i.e., avoiding upset, since there is not a loss of separation efficiency.

Second, the present invention allows for more adjustment of the temperature and pressure profile of a sequentially configured or downstream fractionation column to optimize separation efficiency and heat integration. In the case of a rich inlet gas stream, the present invention allows the fractionation column to be operated at lower pressure and/or lower temperature for improved separation of $C_2$ compounds and/or $C_3$ compounds and heavier compounds. Also, operating the fractionation column at a lower pressure reduces the heat duty of the column. Heat energy contained in various process stream may be used for fractionation column side reboiler duty or overhead condenser duty or to pre-cool inlet gas streams.

Third, energy and heat integration of the separation process is improved by operating the absorber at higher pressure. The energy contained in high pressure liquid and vapor streams from the absorber, for example, may be tapped by coupling isentropic expansion steps, such as in a turbo expander, with gas compression steps.

Finally, the invention allows for the elimination of liquid pumps between the absorber and the fractionation column and the capital cost associated with such. All streams between the columns may flow by the pressure differentials between the columns.

While the present invention has been described and/or illustrated with particular reference to the process for the separation of gaseous hydrocarbons compounds, such as natural gas, it is noted that the scope of the present invention is not restricted to the embodiment(s) described. It should be apparent to those skilled in the art that the scope of the invention includes other methods and applications using other equipment or processes than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

We claim:

1. A process for separating a heavy key component from an inlet gas stream containing a mixture of methane, $C_2$ compounds, $C_3$ compounds, and heavier compounds, comprising the following steps:

(a) at least partially condensing and separating the inlet gas to produce a first liquid stream and a first vapor stream;

(b) expanding at least a portion of the first liquid stream to produce a first fractionation feed stream;

(c) supplying a fractionation column the first fractionation feed stream and a second fractionation feed stream, the fractionation column produces a fractionation overhead vapor stream and a fractionation bottom stream;

(d) expanding at least a portion of the first vapor stream to produce an expanded vapor stream;

(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;

(f) compressing at least a portion of the fractionation overhead vapor stream or a second vapor stream essentially to the absorber pressure to produce a compressed second vapor stream and to control the fractionation column pressure by maintaining the predetermined differential pressure from the absorber pressure;

(g) at least partially condensing the compressed second vapor stream to produce the absorber feed stream; and whereby the fractionation bottom stream contains a majority of the heavy key component and heavier compounds.

2. The process for separating the heavy key component of claim 1 wherein the absorber pressure is at least about 500 psia.

3. The process for separating the heavy key component of claim 1 wherein the differential pressure in step (e) is about 50 psi to 350 psi.

4. The process for separating the heavy key component of claim 1 wherein the at least partially condensing of step (a) occurs in an apparatus selected from the group consisting of a heat exchanger, a liquid expander, vapor expander, an expansion valve and combinations thereof.

5. The process for separating the heavy key component of claim 1 wherein the first fractionation feed stream and the second fractionation feed stream of step (c) are supplied to a middle portion of the fractionation column.

6. The process for separating the heavy key component of claim 1 wherein the compressed second vapor stream of step (f) contains a major portion of the methane in the fractionation feed stream and second fractionation feed stream.

7. The process for separating the heavy key component of claim 6 wherein the heavy key component is $C_3$ compounds and heavier compounds and the compressed second vapor stream contains a major portion of the $C_2$ compounds in the fractionation feed stream and the second fractionation feed stream.

8. The process for separating the heavy key component of claim 1 wherein the absorber of step (e) has at least one vertically spaced tray, one or more packed beds, any other type of mass transfer device, or a combination thereof.

9. The process for separating the heavy key component of claim 1 wherein the fractionation column of step (c) has at least one vertically spaced tray, one or more packed beds, any other type of mass transfer device, or a combination thereof.

10. The process for separating the heavy key component of claim 1, wherein the heavy key component is $C_3$ compounds and heavier compounds and further comprises the following steps:

(a) at least partially condensing the fractionation overhead vapor stream to produce a condensed fractionation overhead stream;

(b) separating the condensed fractionation overhead stream to produce a second vapor stream and a fractionation reflux stream;

(c) supplying the fractionation column with the fractionation reflux stream;

(d) cooling the fractionation bottom stream and supplying a portion of the fractionation bottom stream to the fractionation column as a fractionation reflux stream;

(e) condensing at least a portion of the first liquid stream before producing the first fractionation column stream from step (b); and whereby the fractionation bottom stream contains the majority of the heavy key component and heavier compounds.

11. The process for separating the heavy key component of claim 10 further comprising the following steps:

(a) heating at least a remaining portion of the first liquid stream producing a third fractionation feed stream; and (b) supplying the third fractionation feed stream to the fractionation tower or to the first fractionation feed stream.

12. The process for separating $C_3$ compounds and heavier compounds of claim 10 further comprising the following steps:

(a) expanding the absorber bottom stream;

(b) at least partially condensing the absorber bottom stream to form a condensed absorber bottom stream;

(c) separating the condensed absorber bottom stream into a separated vapor stream and a separated liquid stream where the first separated liquid stream is 0% to 100% of the separated liquid stream;

(d) separating the separated liquid stream into a first separated liquid stream and a second separated liquid stream;

(e) supplying the second separated liquid stream to the fractionation column;

(f) combining the first separated liquid stream with the separated vapor stream to form the second fractionation feed stream;

(g) heating the second fractionation feed stream; and (h) supplying the second fractionation feed stream to the fractionation column.

13. The process for separating the heavy key component of claim 10 wherein the heavy key component is $C_3$ compounds and heavier compounds and the condensing of step (g) from claim 1 occurs by heat exchange contact with one or more process streams selected from the group consisting of the absorber bottom stream, the absorber overhead stream, at least a portion of the first liquid stream and combinations thereof.

14. The process of separating the heavy key component of claim 10 wherein the heavy key component is $C_3$ compounds and heavier compounds and the first fractionation feed stream and the second fractionation feed stream supplied to the fractionation column are cooled by an heat exchange contact with process streams selected from the group consisting of the absorber overhead stream, inlet gas stream, the compressed second vapor stream, fractionation overhead vapor stream, and combinations thereof.

15. The process of separating the heavy key component of claim 14 wherein the heavy key component is $C_3$ compounds and heavier compounds and the heat exchange contact occurs in an apparatus selected from the group consisting of a heat exchanger and a condenser.

16. The process of separating the heavy key component of claim 10 wherein the heavy key component is $C_3$ compounds and heavier compounds and the first fractionation feed stream supplied to the fractionation column in step (c) of claim 1 is cooled by heat exchange contact with the absorber overhead stream in a heat exchanger;

wherein the fractionation overhead vapor stream in step (c) is at least partially condensed in an external refrigeration system; and wherein step (g) includes condensing the compressed second vapor stream by heat exchange contact with the absorber overhead stream.

17. The process of separating the heavy key component of claim 1 wherein the heavy key component is $C_3$ compounds and heavier compounds and the absorber overhead stream in step (e) is sent to an internal condenser of the fractionation column.

18. The process of separating the heavy key component claim 17 wherein the heavy key component is $C_3$ compounds and heavier compounds are at least partially condensed in the internal condenser that uses an external refrigeration system, producing the fractionation overhead vapor stream.

19. A process for separating the heavy key component of claim 1, wherein the heavy key component is $C_2$ compounds and heavier compounds and further comprising the following steps:

(a) removing a first liquid condensate stream from a removal tray of the fractionation column that is below a lowest feed tray of the fractionation column;

(b) warming the first liquid condensate stream;

(c) returning the first liquid condensate stream back to a return tray of the fractionation column that is between the removal tray and the lowest feed tray;

(d) removing a second liquid condensate stream from a second removal tray of the fractionation column that is between the lowest feed tray and the removal tray;

(e) warming the second liquid condensate stream;

(f) returning the second liquid condensate stream back to the second return tray of the fractionation column that is between the second removal tray and the removal tray;

(g) supplying to the absorber a second absorber feed stream; and whereby the fractionation bottom stream contains the majority of the heavy key component and heavier compounds.

20. The process for separating the heavy key component of claim 19 wherein the heavy key component is $C_2$ compounds and heavier compounds and the condensing of step (g) from claim 1 is by heat exchange contact with a process stream selected from the group consisting of the portion of the first vapor stream portion, the absorber overhead stream and combinations thereof.

21. The process of separating the heavy key component of claim 19 wherein the heavy key component is $C_2$ compounds and heavier compounds and further comprising the step of supplying to the absorber a second absorber feed stream selected from the group consisting of a condensed portion of the second expanded vapor stream and at least a portion of a residue gas second expanded vapor stream.

22. The process of separating the heavy key component of claim 21 wherein the heavy key component is $C_2$ compounds and heavier compounds and further comprising the following steps:

(a) supplying a cold absorber a split feed stream and a second split feed stream;

(b) feeding the colder of the split feed stream and the second split feed stream to the top of the cold absorber; and (c) feeding the wanner of the split feed stream and the second split feed stream to the bottom of the cold absorber.

23. The process of separating the heavy key component of claim 19 wherein the heavy key component is $C_2$ compounds and heavier compounds and further comprising the step of cooling, at least partially condensing, and expanding the second absorber feed stream prior to supplying the second absorber feed stream to the absorber.

24. The process of separating the heavy key component of claim 23 wherein the heavy key component is $C_2$ compounds and heavier compounds and further comprising the step of adding at least a portion of first liquid stream as a liquid slip stream to the second absorber feed stream prior to cooling and at least partially condensing the second absorber feed stream.

25. An apparatus for separating a heavy key component from an inlet gas stream containing a mixture of methane, $C_2$ compounds, $C_3$ compounds and heavier compounds. comprising:

(a) a cooling means for at least partially condensing and separating the inlet gas stream to produce a first vapor stream and a first liquid stream;

(b) an expansion means for expanding the first liquid stream to produce a first fractionation feed stream;

(c) a fractionation column for receiving the first fractionation feed stream and a second fractionation feed stream, the fractionation column produces a fractionation overhead vapor stream and a fractionation bottom stream;

(d) a second expansion means for expanding at least a portion of the first vapor stream to produce an expanded vapor stream;

(e) an absorber for receiving the expanded vapor stream and an absorber feed stream, the absorber produces an absorber overhead stream and an absorber bottom stream, the absorber having an absorber pressure that is substantially greater than and at a predetermined differential pressure from a fractionation column pressure;

(f) a compressor for compressing at least a portion of the fractionation overhead vapor stream or a second vapor stream essentially to the absorber pressure to produce a compressed second vapor stream and for controlling the fractionation column pressure by maintaining the oredetermined differential pressure from the absorber pressure;

(g) a condensing means for at least partially condensing the compressed second vapor stream to produce the absorber feed stream; and whereby the fractionation bottom stream contains the majority of the heavy key component and heavier compounds.

26. The apparatus for separating the heavy key component of claim 25 wherein the absorber pressure of step (e) is at least about 500 psia.

27. The apparatus for separating the heavy key component of claim 25 wherein the differential pressure from step (e) is about 50 psi to 350 psi.

28. The apparatus for separating the heavy key component of claim 25 wherein the cooling means of part (a) is selected from the group consisting of a heat exchanger, a liquid expander, a vapor expander, an expansion valve and combinations thereof.

29. The apparatus for separating the heavy key component of claim 25 wherein the first fractionation feed stream and the second fractionation feed stream are supplied to about a middle portion of the fractionation column.

30. The apparatus for separating the heavy key component of claim 25 wherein the heavy key component is $C_3$ compounds and heavier compounds and further comprising the following:

(a) a condensing means for at least partially condensing the fractionation overhead vapor stream to produce a condensed fractionation overhead stream;

(b) a separating means for separating the condensed fractionation overhead stream to produce a second vapor stream and a fractionation reflux stream;

(c) the fractionation column for receiving the fractionation reflux stream;

(d) a bottoms exchanger for receiving and cooling the fractionation bottom stream and supplying a portion of the fractionation bottom stream to the fractionation column as a fractionation reflux stream; and whereby the fractionation bottom stream contains the majority of the heavy key component and heavier compounds.

31. The apparatus for separating the heavy key component of claim 30 wherein the heavy key component is $C_3$ compounds and heavier compounds and further comprising the following steps:

(a) a heating means for heating at least a remaining portion of the first liquid stream producing a third fractionation feed stream; and (b) the fractionation column or the first fractionation feed stream for receiving the third fractionation feed stream.

32. The apparatus for separating the heavy key component of claim 31 wherein the heavy key component is $C_3$ compounds and heavier compounds and further comprising the following steps:

(a) a third expansion means for expanding the absorber bottom stream;

(b) a cooling means for at least partially condensing the absorber bottom stream to form a condensed absorber bottom stream;

(c) a separating means for separating the condensed absorber bottom stream into a separated vapor stream and a separated liquid stream (d) a second separating means for separating the separated liquid stream into a first separated liquid stream and a second separated liquid stream where the first separated liquid stream is 0% to 100% of the separated liquid stream;

(e) the fractionation column for receiving the second separated liquid stream;

(f) a combining means for combining the first separated liquid stream with the separated vapor stream to form the second fractionation feed stream;

(g) a heating means for heating the second fractionation feed stream; and (h) the fractionation column for receiving the second fractionation feed stream.

33. The apparatus for separating the heavy key component of claim 30 wherein the heavy key component is $C_3$ compounds and heavier compounds and the heat exchanger at least partially condenses the compressed second vapor stream by heat exchange contact with one or more process streams selected from the group consisting of the fractionation feed stream, the absorber overhead stream and combinations thereof.

34. The apparatus for separating the heavy key component of claim 25, wherein the heavy key component is $C_2$ compounds and heavier compounds and further comprising the following steps:

(a) the fractionation column for removing a first liquid condensate stream from a removal tray that is below a lowest feed tray;

(b) a heating means for warming the first liquid condensate stream;

(c) the fractionation colunm for returning the first liquid condensate stream back to a return tray that is between removal tray and the lowest feed tray;

(d) the fractionation column for removing a second liquid condensate stream from a second removal tray that is between the lowest feed tray and the removal tray;

(e) a second heating means for warming the second liquid condensate stream;

(f) the fractionation column for returning the second liquid condensate stream back to a second return tray that is between the second removal tray and the removal tray;

(g) the absorber for receiving a second absorber feed stream; and whereby the fractionation bottom stream contains the majority of the heavy key component and heavier compounds.

35. The apparatus for separating the heavy key component of claim 34 wherein the heavy key component is $C_2$ compounds and heavier compounds and the fractionation column includes one or more side reboilers that are in heat exchange contact with process streams selected from the group consisting at least a portion of the inlet gas stream, at least a portion of a residue gas stream and combination thereof.

36. The apparatus for separating the heavy key component of claim 34 wherein the heavy key component is $C_2$ compounds and heavier compounds and the cooling means of step (a) from claim 24 further comprise a cold absorber with one or more mass transfer stages for receiving at least a portion of a condensed inlet gas stream, the cold absorber producing the first liquid stream and the first vapor stream.

37. The apparatus for separating the heavy key component of claim 25 wherein the absorber of step (e) has at least one vertically spaced tray, one or more packed beds, any other type of mass transfer device, or a combination thereof.

38. The apparatus for separating the heavy key component of claim 25 wherein the fractionation column of step (c) has at least one vertically spaced tray, one or more packed beds, any other type of mass transfer device, or a combination thereof.

39. The apparatus for separating the heavy key component of claim 25 further comprising a vessel for separating a condensed absorber bottom stream into a separated vapor stream and a separated liquid stream.

40. The apparatus for separating the key component of claim 25 wherein the compressed second vapor stream contains a major portion of the methane in the fractionation feed stream and the second fractionation feed stream.

41. The apparatus for separating the heavy key component of claim 40 wherein the heavy key component is $C_3$ compounds and the compressed second vapor stream contains a major portion of the $C_2$ compounds in the fractionation feed stream and the second fractionation feed stream.

42. The apparatus for separating the heavy key component of claim 25 wherein a pressure difference between the absorber and the fractionation column flows the fractionation feed stream to the fractionation column.

43. The apparatus for separating the heavy key component of claim 25 wherein the heavy key component is $C_3$ compounds and heavier compounds and the condensing means is selected from the group consisting of a heat exchanger and an internal condenser of the fractionation column.

44. The apparatus for separating the heavy key component of claim 43 wherein the heavy key component is $C_3$ compounds and heavier compounds and the fractionation overhead stream is at least partially condensed in an external refrigeration system.

45. The apparatus for separating the heavy key component of claim 25 wherein the heavy key component is $C_3$ compounds and heavier compounds and further comprising a compressor for compressing the absorber overhead stream to at least above about 500 psia.

* * * * *

UNITED STATES PATENT AND TRADEMARK OFFICE

CERTIFICATE OF CORRECTION

PATENT NO. : 6,712,880 B2
DATED : March 30, 2004
INVENTOR(S) : Jorge Foglietta et al.

It is certified that error appears in the above-identified patent and that said Letters Patent is hereby corrected as shown below:

Column 17,
Line 13, change “wanner” to -- warmer --
Line 30, change “.” to -- , --
Line 56, change “oredetermined” to -- predetermined --

Column 18,
Line 52, after “stream” insert -- ; --

Signed and Sealed this

Third Day of May, 2005

JON W. DUDAS
*Director of the United States Patent and Trademark Office*

US006712880C1

(12) INTER PARTES REEXAMINATION CERTIFICATE (572nd)

United States Patent

Foglietta et al.

(10) Number: US 6,712,880 C1

(45) Certificate Issued: Apr. 2, 2013

(54) CRYOGENIC PROCESS UTILIZING HIGH PRESSURE ABSORBER COLUMN

(75) Inventors: Jorge H. Foglietta, Missouri City, TX (US); Hazem Haddad, Houston, TX (US); Earle Ross Mowrey, Houston, TX (US); Sanjiv N. Patel, Sugarland, TX (US); Ajit Sangave, Houston, TX (US)

(73) Assignee: ABB Lummus Global, Inc., Houston, TX (US)

Reexamination Request:
No. 95/001,168, Apr. 13, 2009

Reexamination Certificate for:

| | |
|---|---|
| Patent No.: | **6,712,880** |
| Issued: | **Mar. 30, 2004** |
| Appl. No.: | **10/003,388** |
| Filed: | **Oct. 22, 2001** |

Certificate of Correction issued May 3, 2005.

Related U.S. Application Data

(60) Provisional application No. 60/272,417, filed on Mar. 1, 2001, provisional application No. 60/274,069, filed on Mar. 7, 2001.

(51) Int. Cl.
*F25J 3/02* (2006.01)

(52) U.S. Cl.
USPC ..... 95/184; 62/618; 62/625; 95/204; 95/227; 95/228; 95/237

(58) Field of Classification Search ..... None
See application file for complete search history.

(56) References Cited

To view the complete listing of prior art documents cited during the proceeding for Reexamination Control Number 95/001,168, please refer to the USPTO's public Patent Application Information Retrieval (PAIR) system under the Display References tab.

*Primary Examiner* — Alan Diamond

(57) ABSTRACT

A cryogenic process and apparatus for separating multicomponent gaseous hydrocarbon streams to recover both gaseous and liquid compounds. More particularly, the cryogenic processes and apparatus of this invention utilize a high pressure absorber to improve the energy efficiency of processing natural gas for pipeline gas sales and recovering natural gas liquids (NGL) gas from gaseous hydrocarbon streams.

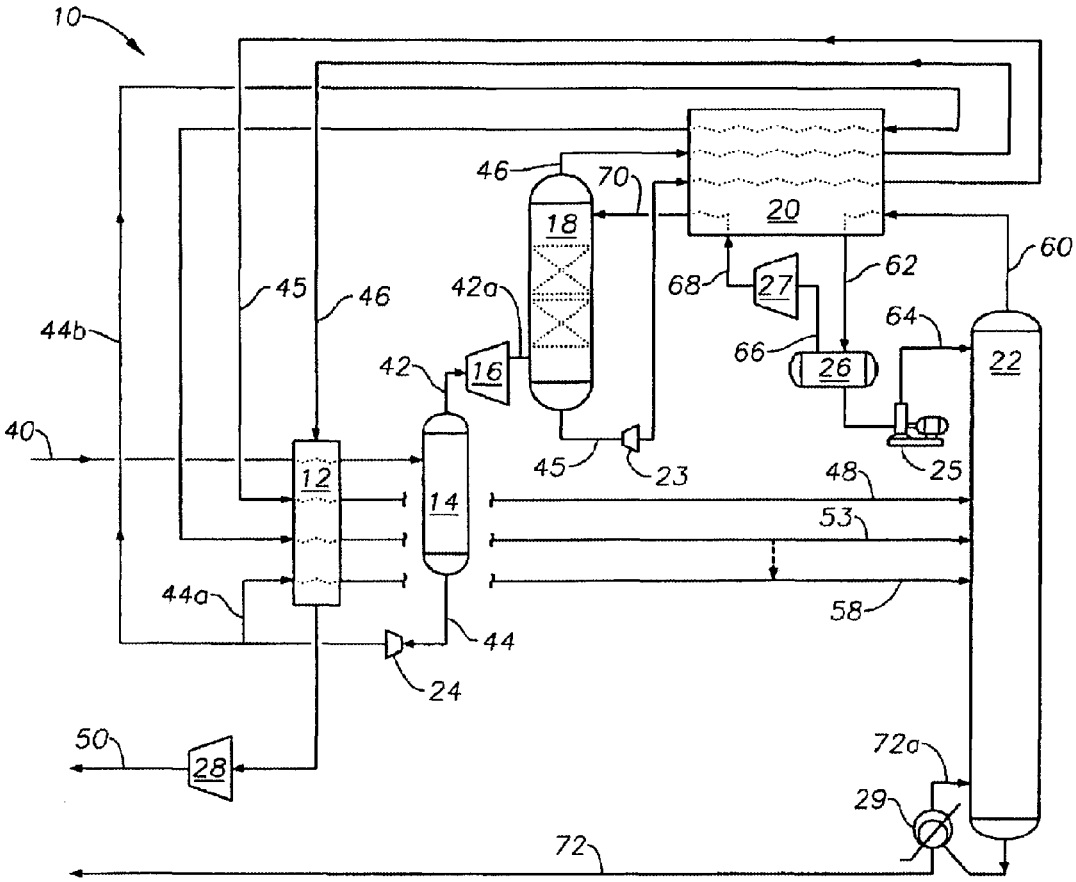

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 10 and 30 are cancelled.

Claims 1, 6, 11-14, 16, 20, 25, 31, 33 and 36 are determined to be patentable as amended.

Claims 2-5, 7-9, 15, 17-19, 21-24, 26-29, 32, 34, 35 and 37-45, dependent on an amended claim, are determined to be patentable.

New claims 46-59 are added and determined to be patentable.

1. A process for separating a heavy key component from an inlet gas stream containing a mixture of methane, $C_2$ compounds, $C_3$ compounds, and heavier compounds, comprising the following steps:

(a) at least partially condensing and separating the inlet gas [to produce] *into* a first liquid stream and a first vapor stream;

(b) expanding at least a portion of the first liquid stream [to produce] *, at least a portion of which is then designated as* a first fractionation feed stream;

(c) supplying a fractionation column the first fractionation feed stream and a second fractionation feed stream, the fractionation column produces a fractionation overhead vapor stream and a fractionation bottom stream;

(d) expanding at least a portion of the first vapor stream [to produce] *, such expanded portion then designated as* an expanded vapor stream;

(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;

*(f) supplying the fractionation overhead vapor stream to an overhead condenser to at least partially condense the overhead vapor stream, such condensed portion then designated as an at least partially condensed overhead stream;*

*(g) supplying the at least partially condensed overhead stream to a separator which separates the partially condensed overhead stream into a second fractionation overhead vapor stream and a reflux stream; (h) supplying the reflux stream to the fractionation column as a third fractionation feed stream;*

[(f)] *(i)* compressing at least a portion of the *second* fractionation overhead vapor stream or a second vapor stream essentially to the absorber pressure [to produce] *, such compressed stream then designated as* a compressed second vapor stream [and to] *which* [control] *controls* the fractionation column pressure by maintaining the predetermined differential pressure from the absorber pressure;

[(g)] *(j)* at least partially condensing the compressed second vapor stream [to produce] *, such compressed second vapor stream then designated as* the absorber feed stream; [and]*(k) separating the fractionation bottom stream into a product stream and a bottoms recycle stream; and (l) supplying the bottoms recycle stream to the fractionation column as a fourth fractionation column feed stream; and* whereby the [fractionation bottom] *product* stream contains a majority of the heavy key component and heavier compounds.

6. The process for separating the heavy key component of claim 1 wherein the compressed second vapor stream of step [(f)] *(i)* contains a major portion of the methane in the fractionation feed stream and second fractionation feed stream.

11. The process for separating the heavy key component of claim [10] *1* further comprising the following steps:

(a) heating at least a remaining portion of the first liquid stream producing a [third] *fifth* fractionation feed stream; and (b) supplying the [third] *fifth* fractionation feed stream to the fractionation tower or to the first fractionation feed stream.

12. The process for separating $C_3$ compounds and heavier compounds of claim [10] *1* further comprising the following steps:

(a) expanding the absorber bottom stream;

(b) at least partially condensing the absorber bottom stream to form a condensed absorber bottom stream;

(c) separating the condensed absorber bottom stream into a separated vapor stream and a separated liquid stream where the first separated liquid stream is 0% to 100% of the separated liquid stream;

(d) separating the separated liquid stream into a first separated liquid stream and a second separated liquid stream;

(e) supplying the second separated liquid stream to the fractionation column;

(f) combining the first separated liquid stream with the separated vapor stream to form the second fractionation feed stream;

(g) heating the second fractionation feed stream; and (h) supplying the second fractionation feed stream to the fractionation column.

13. The process for separating the heavy key component of claim [10] *1* wherein the heavy key component is $C_3$ compounds and heavier compounds and the condensing of step [(g)] *(j)* from claim 1 occurs by heat exchange contact with one or more process streams selected from the group consisting of the absorber bottom stream, the absorber overhead stream, at least a portion of the first liquid stream and combinations thereof.

14. The process of separating the heavy key component of claim [10] *1* wherein the heavy key component is $C_3$ compounds and heavier compounds and the first fractionation feed stream and the second fractionation feed stream supplied to the fractionation column are cooled by an heat exchange contact with process streams selected from the group consisting of the absorber overhead stream, inlet gas stream, the compressed second vapor stream, [fractionation overhead vapor stream,] and combinations thereof.

16. The process of separating the heavy key component of claim [10] *1* wherein the heavy key component is $C_3$ compounds and heavier compounds and the first fractionation feed stream supplied to the fractionation column in step (c) of claim 1 is cooled by heat exchange contact with the absorber overhead stream in a heat exchanger;

wherein the fractionation overhead vapor stream in step (c) is at least partially condensed in an external refrigeration system; and wherein step [(g)] (*j*) includes condensing the compressed second vapor stream by heat exchange contact with the absorber overhead stream.

20. The process for separating the heavy key component of claim 19 wherein the heavy key component is $C_2$ compounds and heavier compounds and the condensing of step [(g)] (*j*) from claim 1 is by heat exchange contact with a process stream selected from the group consisting of the portion of the first vapor stream portion, the absorber overhead stream and combinations thereof.

25. An apparatus for separating a heavy key component from an inlet gas stream containing a mixture of methane, $C_2$ compounds, $C_3$ compounds and heavier compounds comprising:

(a) a cooling means for at least partially condensing and separating the inlet gas stream [to produce] *into* a first vapor stream and a first liquid stream;

(b) an expansion means for expanding the first liquid stream [to produce] , *at least a portion of which is then designated as* a first fractionation feed stream;

(c) a fractionation column for receiving the first fractionation feed stream and a second fractionation feed stream, the fractionation column produces a fractionation overhead vapor stream and a fractionation bottom stream;

(d) a second expansion means for expanding at least a portion of the first vapor stream [to produce] , *such expanded portion then designated as* an expanded vapor stream;

(e) an absorber for receiving the expanded vapor stream and an absorber feed stream, the absorber produces an absorber overhead stream and an absorber bottom stream, the absorber having an absorber pressure that is substantially greater than and at a predetermined differential pressure from a fractionation column pressure;

(*f*) *a condensing means for at least partially condensing the fractionation overhead vapor stream, such condensed portion then designated as an at least partially condensed overhead vapor stream;*

(*g*) *a separator for separating the partially condensed overhead stream into a second fractionation overhead vapor stream and a reflux stream;*

(*h*) *a pump to supply the reflux stream to the fractionation column as a third fractionation feed stream;*

[(f)] (*i*) a compressor for compressing at least a portion of the *second* fractionation overhead vapor stream or a second vapor stream essentially to the absorber pressure, *such compressed stream then designated as* a compressed second vapor stream, and for controlling the fractionation column pressure by maintaining the predetermined differential pressure from the absorber pressure;

[(g)] (*j*) a *second* condensing means for at least partially condensing the compressed second vapor stream [to produce] , *such compressed second vapor stream then designated as* the absorber feed stream;

(*k*) *a bottoms exchanger for separating a fractionation bottom stream into a product stream and a recycle stream which is supplied to the fractionation column as a fourth fractionation column feed stream;* and

[whereby] *wherein* the fractionation bottom stream contains the majority of the heavy key component and heavier compounds.

31. The apparatus for separating the heavy key component of claim [30] *25* wherein the heavy key component is $C_3$ compounds and heavier compounds and further comprising the following [steps]:

(a) a heating means for heating at least a remaining portion of the first liquid stream producing a [third] *fifth* fractionation feed stream; and (b) the fractionation column or the first fractionation feed stream for receiving the [third] *fifth* fractionation feed stream.

33. The apparatus for separating the heavy key component of claim [30] *25* wherein the heavy key component is $C_3$ compounds and heavier compounds and the heat exchanger at least partially condenses the compressed second vapor stream by heat exchange contact with one or more process streams selected from the group consisting of the fractionation feed stream, the absorber overhead stream and combinations thereof.

36. The apparatus for separating the heavy key component of claim 34 wherein the heavy key component is $C_2$ compounds and heavier compounds and the cooling means of step (a) from claim [24] *25* further comprise a cold absorber with one or more mass transfer stages for receiving at least a portion of a condensed inlet gas stream, the cold absorber producing the first liquid stream and the first vapor stream.

*46. The process of claim 1 wherein each of the fractionation feed streams is of a different chemical composition.*

*47. The apparatus of claim 25 wherein each of the fractionation feed streams is of a different chemical composition.*

*48. A process for separating a heavy key component from an inlet gas stream containing a mixture of methane, $C_2$ compounds, $C_3$ compounds, and heavier compounds, comprising the following steps:*

(*a*) *at least partially condensing and separating the inlet gas to produce a first liquid stream and a first vapor stream;*

(*b*) *expanding at least a portion of the first liquid stream to produce a first fractionation feed stream;*

(*c*) *supplying a fractionation column the first fractionation feed stream and a second fractionation feed stream, the fractionation column produces a fractionation overhead vapor stream and a fractionation bottom stream;*

(*d*) *expanding at least a portion of the first vapor stream to produce an expanded vapor stream;*

(*e*) *supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;*

(*f*) *compressing at least a portion of the fractionation overhead vapor stream or a second vapor stream essentially to the absorber pressure to produce a compressed second vapor stream and to control the fractionation column pressure by maintaining the predetermined differential pressure from the absorber pressure;*

(*g*) *at least partially condensing the compressed second vapor stream to produce the absorber feed stream;*

(*h*) *at least partially condensing the fractionation overhead vapor stream to produce a condensed fractionation overhead stream;*

(*i*) *separating the condensed fractionation overhead stream to produce a second vapor stream and a fractionation reflux stream;*

(*j*) *supplying the fractionation column with the fractionation reflux stream;*

(k) cooling the fractionation bottom stream and supplying a portion of the fractionation bottom stream to the fractionation column as a fractionation reflux stream;

(l) condensing at least a portion of the first liquid stream before producing the first fractionation column stream from step (b);

(m) heating at least a remaining portion of the first liquid stream producing a third fractionation feed stream; and (n) supplying the third fractionation feed stream to the fractionation tower or to the first fractionation feed stream;

whereby the fractionation bottom stream contains the majority of the heavy key component and heavier compounds.

49. The process for separating $C_3$ compounds and heavier compounds of claim 48 further comprising the following steps:

(o) expanding the absorber bottom stream;

(p) at least partially condensing the absorber bottom stream to form a condensed absorber bottom stream;

(q) separating the condensed absorber bottom stream into a separated vapor stream and a separated liquid stream where the first separated liquid stream is 0% to 100% of the separated liquid stream;

(r) separating the separated liquid stream into a first separated liquid stream and a second separated liquid stream;

(s) supplying the second separated liquid stream to the fractionation column;

(t) combining the first separated liquid stream with the separated vapor stream to form the second fractionation feed stream;

(u) heating the second fractionation feed stream; and (v) supplying the second fractionation feed stream to the fractionation column.

50. A process for separating a heavy key component from an inlet gas stream containing a mixture of methane, $C_2$ compounds, $C_3$ compounds, and heavier compounds, comprising the following steps:

(a) at least partially condensing and separating the inlet gas to produce a first liquid stream and a first vapor stream;

(b) expanding at least a portion of the first liquid stream to produce a first fractionation feed stream;

(c) supplying a fractionation column the first fractionation feed stream and a second fractionation feed stream, the fractionation column produces a fractionation overhead vapor stream and a fractionation bottom stream;

(d) expanding at least a portion of the first vapor stream to produce an expanded vapor stream;

(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;

(f) compressing at least a portion of the fractionation overhead vapor stream or a second vapor stream essentially to the absorber pressure to produce a compressed second vapor stream and to control the fractionation column pressure by maintaining the predetermined differential pressure from the absorber pressure;

(g) at least partially condensing the compressed second vapor stream to produce the absorber feed stream;

(h)at least partially condensing the fractionation overhead vapor stream to produce a condensed fractionation overhead stream;

(i) separating the condensed fractionation overhead stream to produce a second vapor stream and a fractionation reflux stream;

(j) supplying the fractionation column with the fractionation reflux stream;

(k) cooling the fractionation bottom stream and supplying a portion of the fractionation bottom stream to the fractionation column as a fractionation reflux stream;

(l) condensing at least a portion of the first liquid stream before producing the first fractionation column stream from step (b);

wherein the heavy key component is $C_3$ compounds and heavier compounds and the first fractionation feed stream and the second fractionation feed stream supplied to the fractionation column are cooled by an heat exchange contact with process streams selected from the group consisting of the absorber overhead stream, inlet gas stream, the compressed second vapor stream, fractionation overhead vapor stream, and combinations thereof.

51. The process of separating the heavy key component of claim 50 wherein the heat exchange contact occurs in an apparatus selected from the group consisting of a heat exchanger and a condenser.

52. A process for separating a heavy key component from an inlet gas stream containing a mixture of methane, $C_2$ compounds, $C_3$ compounds, and heavier compounds, comprising the following steps:

(a) at least partially condensing and separating the inlet gas to produce a first liquid stream and a first vapor stream;

(b) expanding at least a portion of the first liquid stream to produce a first fractionation feed stream;

(c) supplying a fractionation column the first fractionation feed stream and a second fractionation feed stream, the fractionation column produces a fractionation overhead vapor stream and a fractionation bottom stream;

(d) expanding at least a portion of the first vapor stream to produce an expanded vapor stream;

(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;

(f) compressing at least a portion of the fractionation overhead vapor stream or a second vapor stream essentially to the absorber pressure to produce a compressed second vapor stream and to control the fractionation column pressure by maintaining the predetermined differential pressure from the absorber pressure;

(g) at least partially condensing the compressed second vapor stream to produce the absorber feed stream;

(h)at least partially condensing the fractionation overhead vapor stream to produce a condensed fractionation overhead stream;

(i) separating the condensed fractionation overhead stream to produce a second vapor stream and a fractionation reflux stream;

(j) supplying the fractionation column with the fractionation reflux stream;

(k) cooling the fractionation bottom stream and supplying a portion of the fractionation bottom stream to the fractionation column as a fractionation reflux stream;

(l) condensing at least a portion of the first liquid stream before producing the first fractionation column stream from step (b);

*wherein the heavy key component is $C_3$ compounds and heavier compounds and the first fractionation feed stream supplied to the fractionation column in step (c) is cooled by heat exchange contact with the absorber overhead stream in a heat exchanger;*

*wherein the fractionation overhead vapor stream in step (c) is at least partially condensed in an external refrigeration system; and*

*wherein step (g) includes condensing the compressed second vapor stream by heat exchange contact with the absorber overhead stream.*

*53. A process for separating a heavy key component from an inlet gas stream containing a mixture of methane, $C_2$ compounds, $C_3$ compounds, and heavier compounds, comprising the following steps:*

*(a) at least partially condensing and separating the inlet gas to produce a first liquid stream and a first vapor stream;*

*(b) expanding at least a portion of the first liquid stream to produce a first fractionation feed stream;*

*(c) supplying a fractionation column the first fractionation feed stream and a second fractionation feed stream, the fractionation column produces a fractionation overhead vapor stream and a fractionation bottom stream;*

*(d) expanding at least a portion of the first vapor stream to produce an expanded vapor stream;*

*(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure,*

*(f) compressing at least a portion of the fractionation overhead vapor stream or a second vapor stream essentially to the absorber pressure to produce a compressed second vapor stream and to control the fractionation column pressure by maintaining the predetermined differential pressure from the absorber pressure;*

*(g) at least partially condensing the compressed second vapor stream to produce the absorber feed stream;*

*wherein the heavy key component is $C_3$ compounds and heavier compounds and the absorber overhead stream in step (e) is sent to an internal condenser of the fractionation column; and*

*whereby the fractionation bottom stream contains a majority of the heavy key component and heavier compounds.*

*54. The process of separating the heavy key component of claim 53 wherein the heavy key component is $C_3$ compounds and heavier compounds are at least partially condensed in the internal condenser that uses an external refrigeration system, producing the fractionation overhead vapor stream.*

*55. An apparatus for separating a heavy key component from an inlet gas stream containing a mixture of methane, $C_2$ compounds, $C_3$ compounds and heavier compounds, comprising:*

*(a) a cooling means for at least partially condensing and separating the inlet gas stream to produce a first vapor stream and a first liquid stream;*

*(b) an expansion means for expanding the first liquid stream to produce a first fractionation feed stream;*

*(c) a fractionation column for receiving the first fractionation feed stream and a second fractionation feed stream, the fractionation column produces a fractionation overhead vapor stream and a fractionation bottom stream;*

*(d) a second expansion means for expanding at least a portion of the first vapor stream to produce an expanded vapor stream;*

*(e) an absorber for receiving the expanded vapor stream and an absorber feed stream, the absorber produces an absorber overhead stream and an absorber bottom stream, the absorber having an absorber pressure that is substantially greater than and at a predetermined differential pressure from a fractionation column pressure;*

*(f) a compressor for compressing at least a portion of the fractionation overhead vapor stream or a second vapor stream essentially to the absorber pressure to produce a compressed second vapor stream and for controlling the fractionation column pressure by maintaining the predetermined differential pressure from the absorber pressure;*

*(g) a condensing means for at least partially condensing the compressed second vapor stream to produce the absorber feed stream;*

*(h) a vessel for separating a condensed absorber bottom stream into a separated vapor stream and a separated liquid stream; and*

*whereby the fractionation bottom stream contains the majority of the heavy key component and heavier compounds.*

*56. A process for separating a heavy key component from an inlet gas stream containing a mixture of methane, $C_2$ compounds, $C_3$ compounds, and heavier compounds, comprising the following steps:*

*(a) at least partially condensing and separating the inlet gas into a first liquid stream and a first vapor stream;*

*(b) expanding at least a portion of the first liquid stream, at least a portion of which is then designated as a first fractionation feed stream;*

*(c) supplying a fractionation column the first fractionation feed stream and a second fractionation feed stream, the fractionation column produces a fractionation overhead vapor stream and a fractionation bottom stream;*

*(d) expanding at least a portion of the first vapor stream, such expanded portion then designated as an expanded vapor stream;*

*(e) supplying an absorber the expanded vapor stream and an absorber feed stream, the absorber produces an absorber overhead stream and an absorber bottom stream, the absorber having an absorber pressure that is substantially greater than and at a predetermined differential pressure from a fractionation column pressure;*

*(f) compressing at least a portion of the fractionation overhead vapor stream or a second vapor stream essentially to the absorber pressure, such compressed stream then designated as a compressed second vapor stream which controls the fractionation column pressure by maintaining the predetermined differential pressure from the absorber pressure;*

*(g) at least partially condensing the compressed second vapor stream, such compressed second vapor stream then designated as the absorber feed stream; and*

*whereby the fractionation bottom stream contains a majority of the heavy key component and heavier compounds.*

*57. The process of separating a heavy key component of claim 56, further comprising:*

*(a) at least partially condensing the fractionation overhead vapor stream to produce a condensed fractionation overhead stream;*

*(b) separating the condensed fractionation overhead stream to produce a second vapor stream and a fractionation reflux stream;*

(c) *supplying the fractionation column with the fractionation reflux stream;*

(d) *cooling the fractionation bottom stream and supplying a portion of the cooled fractionation bottom stream to the fractionation column as a fractionation reflux stream;*

(e) *condensing at least a portion of the first liquid stream before producing the first fractionation column stream from step (b).*

*58. An apparatus for separating a heavy key component from an inlet gas stream containing a mixture of methane, $C_2$ compounds, $C_3$ compounds and heavier compounds. comprising:*

(a) *a cooling means for at least partially condensing and separating the inlet gas stream into a first vapor stream and a first liquid stream;*

(b) *an expansion means for expanding the first liquid stream, at least a portion of which is then designated as a first fractionation feed stream;*

(c) *a fractionation column for receiving the first fractionation feed stream and a second fractionation feed stream, the fractionation column produces a fractionation overhead vapor stream and a fractionation bottom stream;*

(d) *a second expansion means for expanding at least a portion of the first vapor stream, such expanded portion then designated as an expanded vapor stream;*

(e) *an absorber for receiving the expanded vapor stream and an absorber feed stream, the absorber produces an absorber overhead stream and an absorber bottom stream, the absorber having an absorber pressure that is substantially greater than and at a predetermined differential pressure from a fractionation column pressure;*

(f) *a compressor for compressing at least a portion of the fractionation overhead vapor stream or a second vapor stream essentially to the absorber pressure, such compressed stream then designated as a compressed second vapor stream and for controlling the fractionation column pressure by maintaining the predetermined differential pressure from the absorber pressure; (g) a condensing means for at least partially condensing the compressed second vapor stream, such compressed second vapor stream then designated as the absorber feed stream; and*

*whereby the fractionation bottom stream contains the majority of the heavy key component and heavier compounds.*

*59. The apparatus of claim 58, wherein the heavy key component is $C_3$ compounds and heavier compounds and further comprising the following:*

(a) *a condensing means for at least partially condensing the fractionation overhead vapor stream to produce a condensed fractionation overhead stream;*

(b) *a separating means for separating the condensed fractionation overhead stream to produce a second vapor stream and a fractionation reflux stream;*

(c) *the fractionation column for receiving the fractionation reflux stream;*

(d) *a bottoms exchanger for receiving and cooling the fractionation bottom stream and supplying a portion of the cooled fractionation bottom stream to the fractionation column as a fractionation reflux stream.*

* * * * *